US008674796B2

(12) United States Patent
Ito et al.

(10) Patent No.: US 8,674,796 B2
(45) Date of Patent: Mar. 18, 2014

(54) RELAY

(75) Inventors: Shinsuke Ito, Konan (JP); Youichi Hattori, Nagoya (JP); Norihiko Nadanami, Inuyama (JP); Ryuji Inoue, Tajimi (JP); Takeshi Mitsuoka, Kohnan (JP); Takio Kojima, Ichinomiya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/882,684

(22) PCT Filed: Oct. 31, 2011

(86) PCT No.: PCT/JP2011/006096

§ 371 (c)(1),
(2), (4) Date: Apr. 30, 2013

(87) PCT Pub. No.: WO2012/060087

PCT Pub. Date: May 10, 2012

(65) Prior Publication Data

US 2013/0214884 A1 Aug. 22, 2013

(30) Foreign Application Priority Data

Nov. 1, 2010 (JP) ..... 2010-245522
Jan. 17, 2011 (JP) ..... 2011-006553

(51) Int. Cl.
*H01F 3/00* (2006.01)
*H01H 13/00* (2006.01)

(52) U.S. Cl.
USPC ..... 335/260; 335/126; 335/131; 335/132; 335/133; 335/202; 335/255

(58) Field of Classification Search
USPC ..... 335/126, 131, 132, 133, 202, 255, 260
See application file for complete search history.

(56) References Cited

U.S. PATENT DOCUMENTS 5,973,581 A * 10/1999 Jacquin et al. ..... 335/131
6,700,466 B1 3/2004 Yamamoto et al.

(Continued)

FOREIGN PATENT DOCUMENTS

JP 51-100859 U 8/1976
JP 55-040905 Y2 9/1980

(Continued)

OTHER PUBLICATIONS

International Search Report of PCT/JP2011/006096 dated Jan. 31, 2012.

(Continued)

*Primary Examiner* — Ramon Barrera
(74) *Attorney, Agent, or Firm* — Sughrue Mion, PLLC

(57) ABSTRACT

A relay includes: a plurality of fixed terminals arranged to have fixed contacts; and a movable contact member arranged to have a plurality of movable contacts that are correspondingly opposed to the respective fixed contacts. The relay further includes: a driving structure operated to move the movable contact member such that the respective movable contacts come into contact with the corresponding fixed contacts; a plurality of first vessels provided corresponding to the respective fixed terminals and arranged to have insulating property; a second vessel joined with the plurality of first vessels; and an air-tight space formed by the plurality of fixed terminals, the plurality of first vessels and the second vessel to allow the movable contact member and the respective fixed contacts to be placed therein.

12 Claims, 19 Drawing Sheets

(56) References Cited

U.S. PATENT DOCUMENTS

| | | | | |
|---|---|---|---|---|
| 7,859,373 | B2 * | 12/2010 | Yamamoto et al. | 335/126 |
| 7,948,338 | B2 * | 5/2011 | Niimi et al. | 335/126 |
| 8,179,217 | B2 | 5/2012 | Kawaguchi et al. | |
| 8,188,818 | B2 * | 5/2012 | Cho et al. | 335/126 |
| 2010/0060392 | A1 | 3/2010 | Cho et al. | |
| 2013/0214881 | A1 | 8/2013 | Ito et al. | |
| 2013/0214882 | A1 | 8/2013 | Ito et al. | |

FOREIGN PATENT DOCUMENTS

| | | | |
|---|---|---|---|
| JP | 57-170252 | U | 10/1982 |
| JP | 1-145041 | U | 10/1989 |
| JP | 9-320437 | A | 12/1997 |
| JP | 10-326530 | A | 12/1998 |
| JP | 2001-118451 | A | 4/2001 |
| JP | 2002-42628 | A | 2/2002 |
| JP | 2003-308773 | A | 10/2003 |
| JP | 2004-273413 | A | 9/2004 |
| JP | 2004-288643 | A | 10/2004 |
| JP | 2004-355847 | A | 12/2004 |
| JP | 2006-19148 | A | 1/2006 |
| JP | 2008-226547 | A | 9/2008 |
| JP | 2008-282719 | A | 11/2008 |
| JP | 2010-062140 | A | 3/2010 |
| WO | 2010/061576 | A1 | 6/2010 |

OTHER PUBLICATIONS

International Search Report of PCT/JP2011/006098 dated Jan. 31, 2012.

International Search Report of PCT/JP2011/006099 dated Jan. 31, 2012.

Non-Final Office Action dated Jul. 2, 2013 for related U.S. Appl. No. 13/882,640.

Final Office Action dated Oct. 11, 2013 for related U.S. Appl. No. 13/882,640.

* cited by examiner

RELAY

CROSS REFERENCE TO RELATED APPLICATIONS

This is a National Stage of International Application No. PCT/JP2011/006096 filed Oct. 31, 2011, claiming priority based on Japanese Patent Application Nos. 2010-245522 filed Nov. 1, 2010 and 2011-006553 filed Jan. 17, 2011, the contents of all of which are incorporated herein by reference in their entirety.

TECHNICAL FIELD

The present invention relates to a relay.

BACKGROUND ART

According to a known technique adopted for the relay, an air-tight space is internally formed by a closed vessel, a first joint member and a second joint member, and fixed contacts and movable contacts are placed inside the air-tight space (for example, PTL1).

CITATION LIST

Patent Literatures

PTL1: JP H09-320437A
PTL2: JP 2010-62140A

SUMMARY OF INVENTION

Technical Problem

In the relay of this type, an arc may be generated between the contacts when the movable contact is separated from the fixed contact. Especially in a relay mounted on, for example, an electric vehicle, when the movable contact is separated from the fixed contact to cut off the high DC voltage (several hundred volts), a high-current arc may be generated between the fixed contact and the movable contact. Electric arching may cause various troubles in the relay. For example, the arc may cause and scatter the particulates of the component part of a fixed terminal or a movable contact member, so as to establish electrical continuity between fixed terminals. The arc may also cause the joint area of the respective component parts to be molten and thereby fail to maintain the air-tight space. Electric arching may increase the internal pressure of the air-tight space and thereby damage at least part of the component parts that form the air-tight space.

The relay may be provided with permanent magnets, in order to extend and thereby extinguish the generated arc by the Lorentz force. In some direction of a magnetic flux produced by the permanent magnets, however, in the state that the movable contact comes into contact with the fixed contact, the Lorentz force may act on the electric current flowing through the movable contact member in the direction that moves the movable contact member away from the fixed contact. This may result in failing to stably maintain contact between the movable contact and the fixed contact. Especially when the high current (for example, 5000 A or higher) flows in a system including the relay, there may be a difficulty in stably maintaining contact between the contacts.

Firstly, the object of the invention is to provide a technique that reduces the occurrence of trouble caused by electric arching in the relay. Secondly, the object of the invention is to provide the technique that stably maintains contact between a movable contact and a fixed contact in the relay.

Solution to Problem

In order to solve at least part of the above problems, the invention provides various aspects and embodiments described below.

First Aspect:

A relay, comprising:

a plurality of fixed terminals arranged to have fixed contacts; and a movable contact member arranged to have a plurality of movable contacts that are correspondingly opposed to the respective fixed contacts, the relay further comprising:

a driving structure operated to move the movable contact member such that the respective movable contacts come into contact with the corresponding fixed contacts;

a plurality of first vessels provided corresponding to the respective fixed terminals, the plurality of first vessels having insulating property;

a second vessel joined with the plurality of first vessels; and an air-tight space formed by the plurality of fixed terminals, the plurality of first vessels and the second vessel and allowing the movable contact member and the respective fixed contacts to be placed therein.

The relay according to the first aspect includes the plurality of first vessels provided corresponding to the respective fixed terminals and arranged to have insulating properties. Even when arc discharge (hereinafter simply referred to as "arc") causes and scatters the particulates of the component part of the fixed terminal, this structure enables the first vessels to work as the barriers and thereby reduces the possibility that the particulates are accumulated to establish electrical continuity between the respective fixed terminals. In other words, this structure reduces the possibility that electrical continuity is established between the fixed terminals in the OFF state of the relay (in the state that the driving structure is not operated).

Second Aspect:

The relay according to the first aspect, wherein the respective fixed contacts are placed inside the corresponding first vessels in the air-tight space.

In the relay according to the second aspect, the respective fixed contacts are placed inside the respective first vessels. Even when electric arching causes and scatters the particulates of the component part of the fixed terminal, this arrangement enables the first vessels to more effectively prevent spread of the scattered particulates. This more effectively reduces the possibility that the particulates are accumulated to establish electrical continuity between the respective fixed terminals.

Third Aspect:

The relay according to the second aspect, wherein the respective movable contacts are placed inside the corresponding first vessels in the air-tight space.

In the relay according to the third aspect, the respective movable contacts are also placed inside the respective first vessels. Even when electric arching causes and scatters the particulates of the component part of the movable contact member including the movable contacts, this arrangement enables the first vessels to work as the barriers and thereby more effectively reduces the possibility that the particulates are accumulated to establish electrical continuity between the respective fixed terminals. An arc is generated between the movable contact and the fixed contact. The arrangement that not only the fixed contacts but the movable contacts are placed inside the first vessels more effectively reduces the possibility that an arc comes into contact with the joint area between the first vessel and the second vessel.

Fourth Aspect:

The relay according to any one of the first aspect to the third aspect, wherein each of the first vessels has an opening, and the second vessel is joined with at least one of the first vessels in at least either an end face of the opening or an outer peripheral surface of the first vessel.

In the relay according to the fourth aspect, the second vessel is joined with at least either of the end face of the opening and the outer peripheral surface of the first vessel having the insulating property. This reduces the possibility that an arc comes into contact with the joint area between the first vessel and the second vessel. Especially joining the second vessel with the outer peripheral surface of the first vessel more effectively reduces the possibility that an arc comes into contact with the joint area between the first vessel and the second vessel.

Fifth Aspect:

The relay according to any one of the first aspect to the fourth aspect, wherein at least one of the first vessels has a through hole formed to allow one part of one of the fixed terminals to pass through, and another part of the fixed terminal is joined with an outer surface of the first vessel having the through hole.

In the relay according to the fifth aspect, the fixed terminal is joined with the outer surface of the first vessel having the insulating property. This reduces the possibility that an arc comes into contact with the joint area between the first vessel and the fixed terminal.

Sixth Aspect:

The relay according to any one of claims 1 to 5, wherein the movable contact member includes:

a center section that is extended in a direction perpendicular to a moving direction of the movable contact member, the center section being placed inside the second vessel in the air-tight space; and a plurality of extended sections that are extended from the center section toward the respective fixed terminals.

In the relay according to the sixth aspect, the plurality of extended sections control the position where an arc is generated between the movable contact and the fixed contact. This accordingly reduces the possibility that an arc comes into contact with the joint area between the first vessel and the second vessel.

Seventh Aspect:

The relay according to the sixth aspect, wherein the movable contact member further includes opposed sections that are extended from the extended portions in a direction perpendicular to the moving direction, wherein the opposed sections respectively have the movable contacts on respective faces opposed to the corresponding fixed contacts.

In the relay according to the seventh aspect, the structure with the opposed sections increases the volume of the movable contact member in the vicinity of the movable contacts, compared with the structure without the opposed sections. The increased volume serves to quickly decrease the temperature of the opposed sections heated by electric arching.

Eighth Aspect:

The relay according to the sixth aspect, wherein the movable contact member further includes opposed sections that are extended from the extended portions in a direction that is perpendicular to the moving direction and is approximately parallel to a contact surface of each of the fixed contacts with the corresponding movable contact, wherein the opposed sections respectively have the movable contacts, and a contact area where the movable contact comes into contact with the corresponding fixed contact is greater than a cross sectional area of a cut plane of the extended section parallel to the contact surface.

In the relay according to the eighth aspect, the movable contact member has the opposed sections. Compared with the structure without the opposed sections, this structure increases the contact area between the fixed contact and the movable contact and thereby advantageously decreases the contact resistance between the contacts. This reduces heat generation between the contacts in the contact state and thereby reduces the possibility that the fixed contact and the movable contact are molten and adhere to each other.

Ninth Aspect:

The relay according to any one of the first aspect to the eighth aspect, wherein at least one of the plurality of first vessels is in cylindrical shape.

The relay according to the ninth aspect improves the pressure resistance, compared with the structure that all the first vessels are formed in rectangular prism shape. This accordingly reduces the possibility that the relay is damaged.

Tenth Aspect:

The relay according to any one of the first aspect to the ninth aspect, the relay being applied for a system including a power source and a load, the relay further comprising:

a magnet arranged to generate Lorentz force acting on electric current flowing through the movable contact member in a direction that moves the movable contact member closer to the opposed fixed contacts, when electric current flows through the relay during power supply from the power source to the load.

In the relay according to the tenth aspect, the magnets generate the Lorentz force acting in the direction that moves the movable contact member closer to the opposed fixed contacts, in the state that the opposed movable contacts and fixed contacts come into contact with each other. This stably maintains contact between the movable contacts and the fixed contacts opposed to each other. Especially in the state that high current flows through the relay, this structure stably maintains contact between the movable contacts and the fixed contacts opposed to each other.

Eleventh Aspect:

A relay, comprising:

a plurality of fixed terminals arranged to have fixed contacts; and a movable contact member arranged to have a plurality of movable contacts that are correspondingly opposed to the respective fixed contacts, the relay further comprising:

a driving structure operated to move the movable contact member such that the respective movable contacts come into contact with the corresponding fixed contacts;

a single first vessel configured to have a bottom and a plurality of chambers formed corresponding to the plurality of fixed terminals, and having insulating property, wherein the plurality of fixed terminals are inserted through and attached to the bottom, such that the plurality of fixed contacts are placed inside the first vessel and another part of the fixed terminals is placed outside the first vessel;

a second vessel joined with the first vessel; and an air-tight space configured to include the plurality of chambers and formed by the plurality of fixed terminals, the first vessel and the second vessel to allow the movable contact member and the respective fixed contacts to be placed therein, wherein the first vessel has a partition wall member extended from the bottom to a position further away from the bottom than at least a position where the plurality of fixed contacts are located, with respect to a moving direction of the movable contact member, and arranged to part the plurality of chambers from each other, wherein the respective fixed contacts are placed in the respective chambers in the air-tight space.

In the relay according to the eleventh aspect, the first vessel has the partition wall member that parts a plurality of chambers from each other, and the plurality of chambers allow the plurality of fixed contacts to be placed therein. Even when electric arching causes and scatters the particulates of the component part of the fixed terminal, this structure enables the partition wall member of the first vessel to work as the barrier and thereby reduces the possibility that the particulates are accumulated to establish electrical continuity between the respective fixed terminals. In other words, this structure reduces the possibility that electrical continuity is established between the fixed terminals in the OFF state of the relay (in the state that the driving structure is not operated).

Twelfth Aspect:

The relay according to the eleventh aspect, wherein the partition wall member is extended from the bottom to a position further away from the bottom than at least a position where the plurality of movable contacts are located, with respect to the moving direction of the movable contact member, wherein the respective movable contacts are placed in the respective chambers in the air-tight space.

The relay according to the twelfth aspect enables the respective movable contacts to be placed in the respective chambers. Even when electric arching causes and scatters the particulates of the component part of the movable contact member including the movable contacts, this structure enables the partition wall member of the first vessel to work as the battier and thereby more effectively reduces the possibility that the particulates are accumulated to establish electrical continuity between the respective fixed terminals.

The technical feature described in any one of the fourth to the eighth aspects and the tenth aspect may be incorporated into either of the eleventh aspect and the twelfth aspect. For example, the technical feature specifying the shape of the movable contact member described in any of the sixth to the eighth aspects may be incorporated into either of the eleventh aspect and the twelfth aspect.

The present invention may be implemented by any of various applications, for example, the relay, a method of manufacturing the relay and a moving body, such as vehicle or ship, equipped with the relay.

DESCRIPTION OF EMBODIMENTS

Embodiments of the invention are described in the following sequence:

A to G: Respective Embodiments

H: Modifications

A. First Embodiment

A-1. General Structure of Relay

Figure 1:
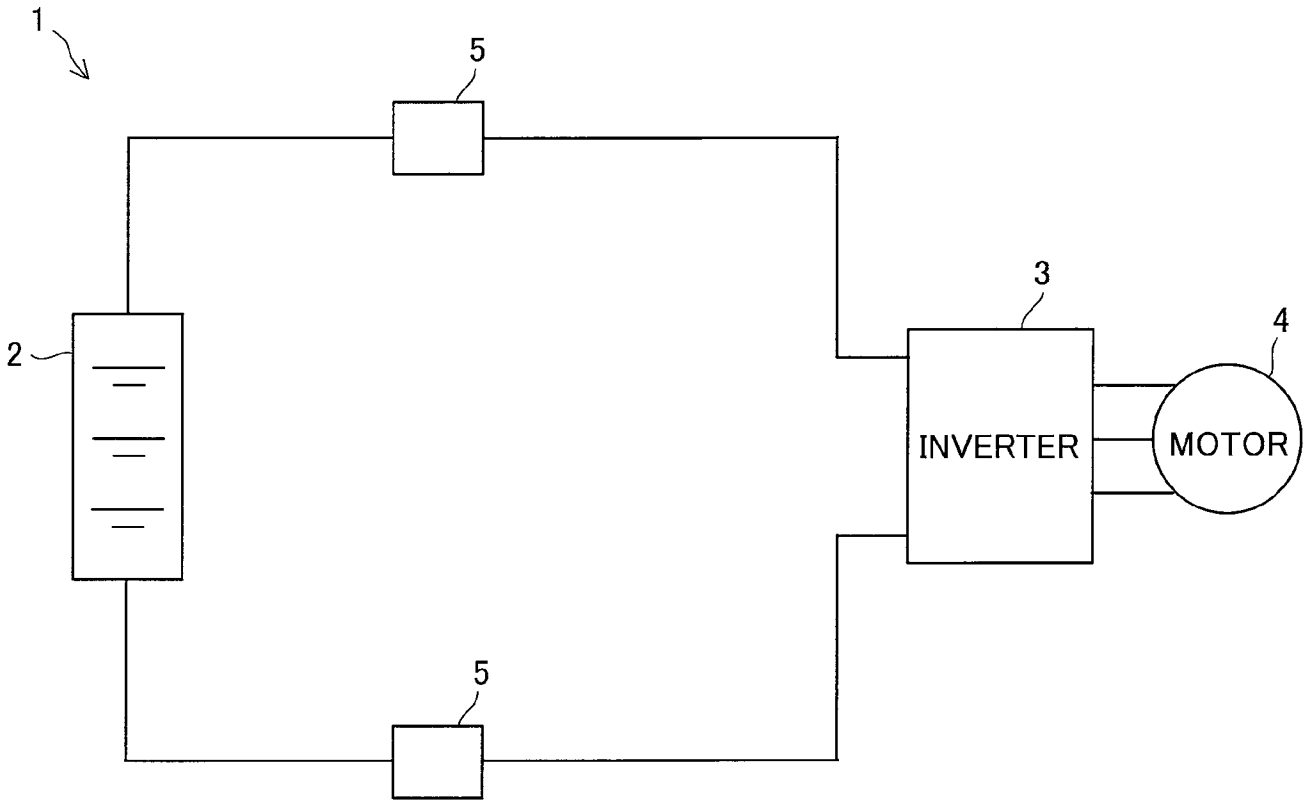
FIG. 1 is a diagram illustrating an electric circuit including a relay 5 according to a first embodiment.

FIG. 1 is a diagram illustrating an electric circuit 1 including a relay 5 according to a first embodiment. The electric circuit 1 is mounted on, for example, a vehicle. The electric circuit 1 includes a DC power source 2, the relay 5, an inverter 3 and a motor 4. The inverter 3 converts the direct current of the DC power source 2 into alternating current. Supplying the alternating current converted by the inverter 3 to the motor 4 drives the motor 4. The driven motor 4 causes the vehicle to run. The relay 5 is located between the DC power source 2 and the inverter 3 to open and close the electric circuit 1. In other words, switching the relay 5 between the ON position and the OFF position opens and closes the electric circuit 1. For example, in the event of an abnormality occurring in the vehicle, the relay 5 works to cut off the electrical connection between the DC power source 2 and the inverter 3.

Figure 2A:
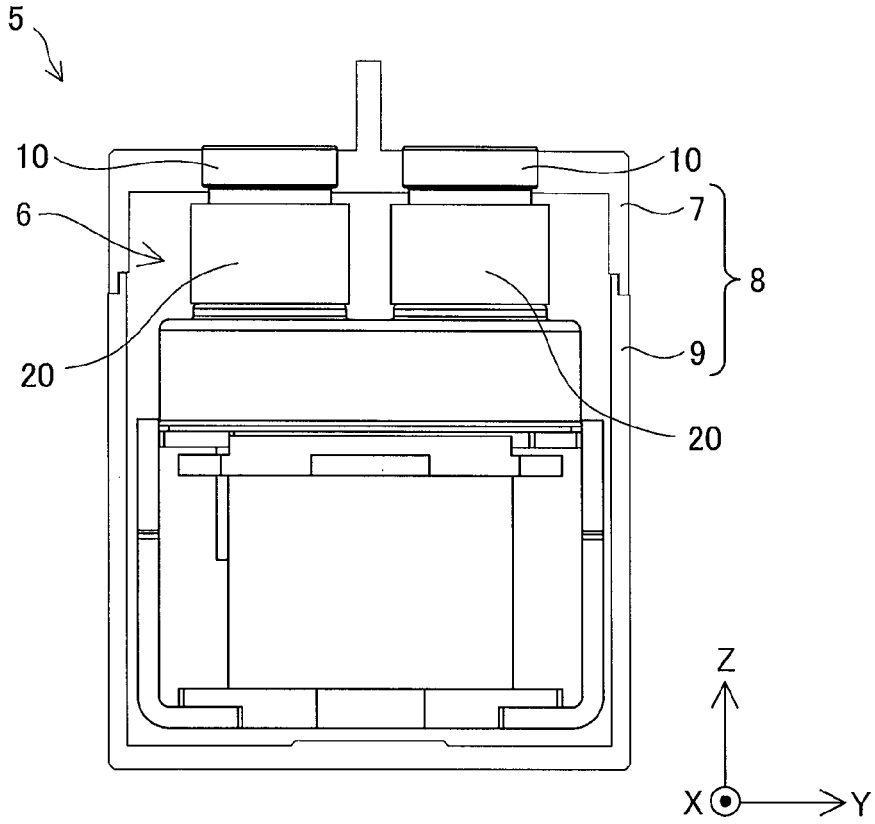
FIG. 2A is a first appearance diagram of the relay 5.
Figure 2B:
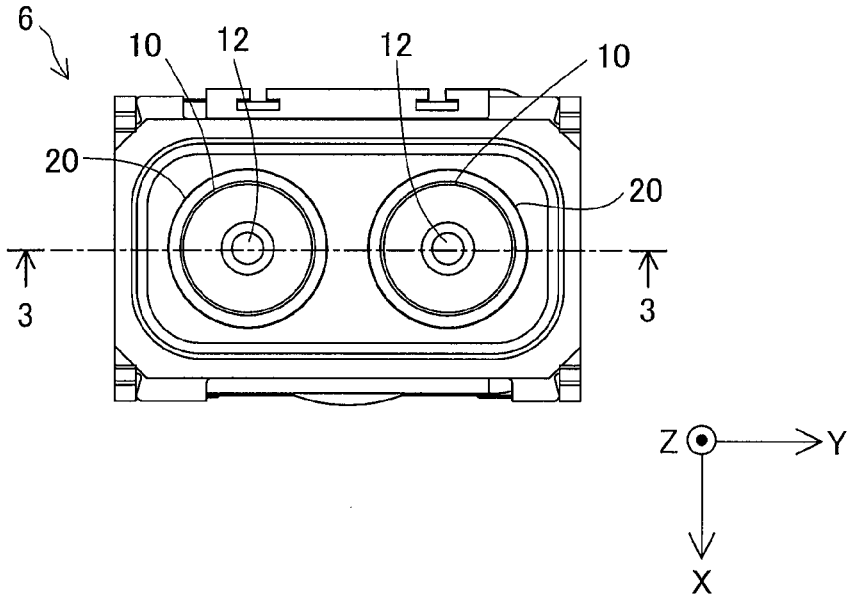
FIG. 2B is a second appearance diagram of the relay 5.

FIGS. 2A and 2B are appearance diagrams of the relay 5. FIG. 2A is a first appearance diagram of the relay 5. FIG. 2B is a second appearance diagram of the relay 5. For the better understanding, the internal structure inside an outer casing 8 is shown by the solid line in FIG. 2A. The outer casing 8 shown in FIG. 2A is omitted from the illustration of FIG. 2B. In order to specify the directions, XYZ axes are shown in FIGS. 2A and 2B. The XYZ axes are shown in other drawings according to the requirements.

As shown in FIG. 2A, the relay 5 includes a relay main unit 6 and the outer casing 8 for protecting the relay main unit 6. The relay main unit 6 includes two fixed terminals 10. The two fixed terminals 10 are linked with first vessels 20. As shown in FIG. 2B, the fixed terminal 10 has a connection port 12 for connection of wiring of the electric circuit 1. As shown in FIG. 2A, the outer casing 8 includes an upper case 7 and a lower case 9. The upper case 7 and the lower case 9 internally form a space for the relay main unit 6. The upper case 7 and the lower case are both made of resin material. The outer casing 8 has permanent magnets (not shown) described later. The magnetic field of the permanent magnets extends the arc by the Lorentz force and thereby accelerates extinction of the arc.

A-2. Detailed Structure of Relay

Figure 3:
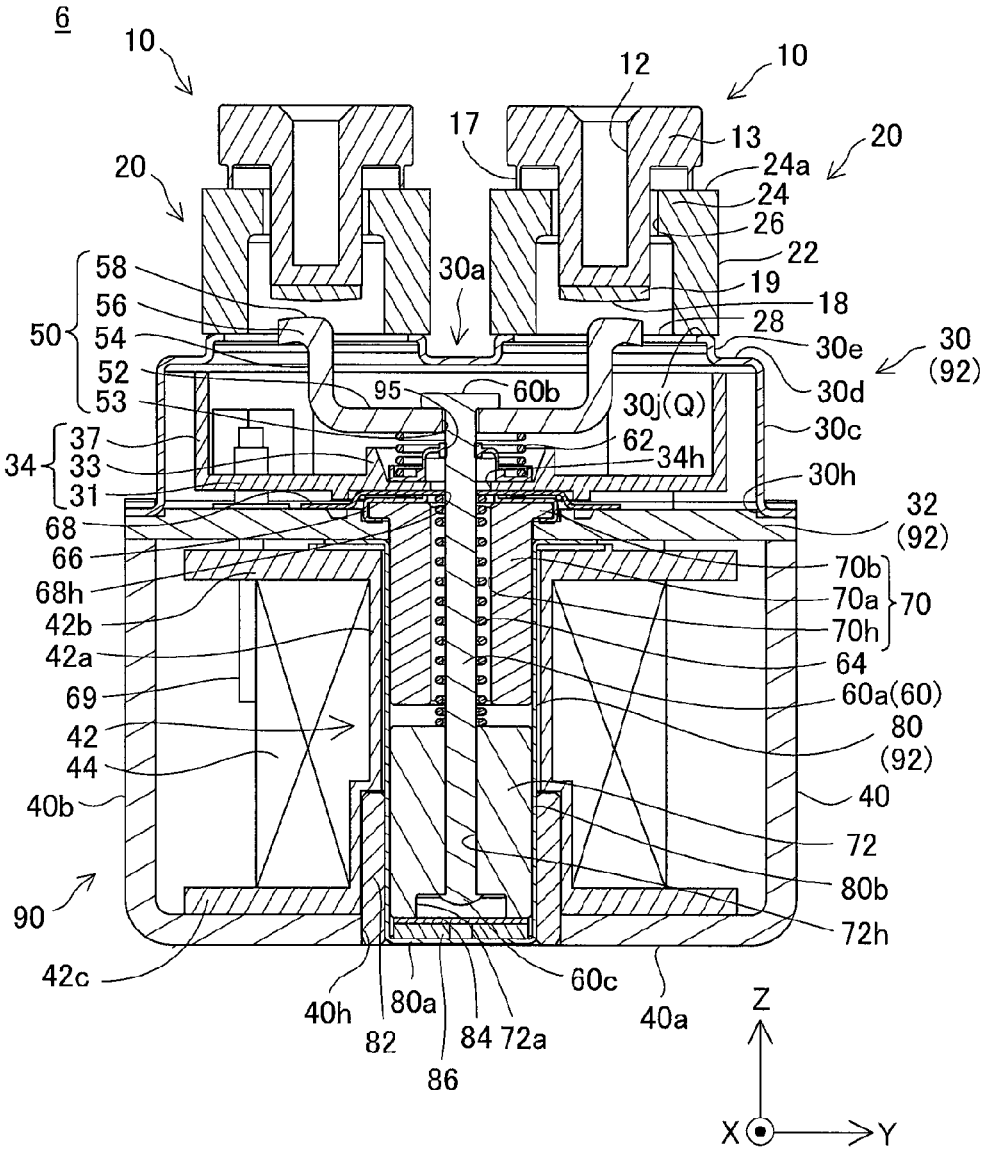
FIG. 3 is a 3-3 cross sectional view of a relay main unit 6 shown in FIG. 2B.
Figure 4:
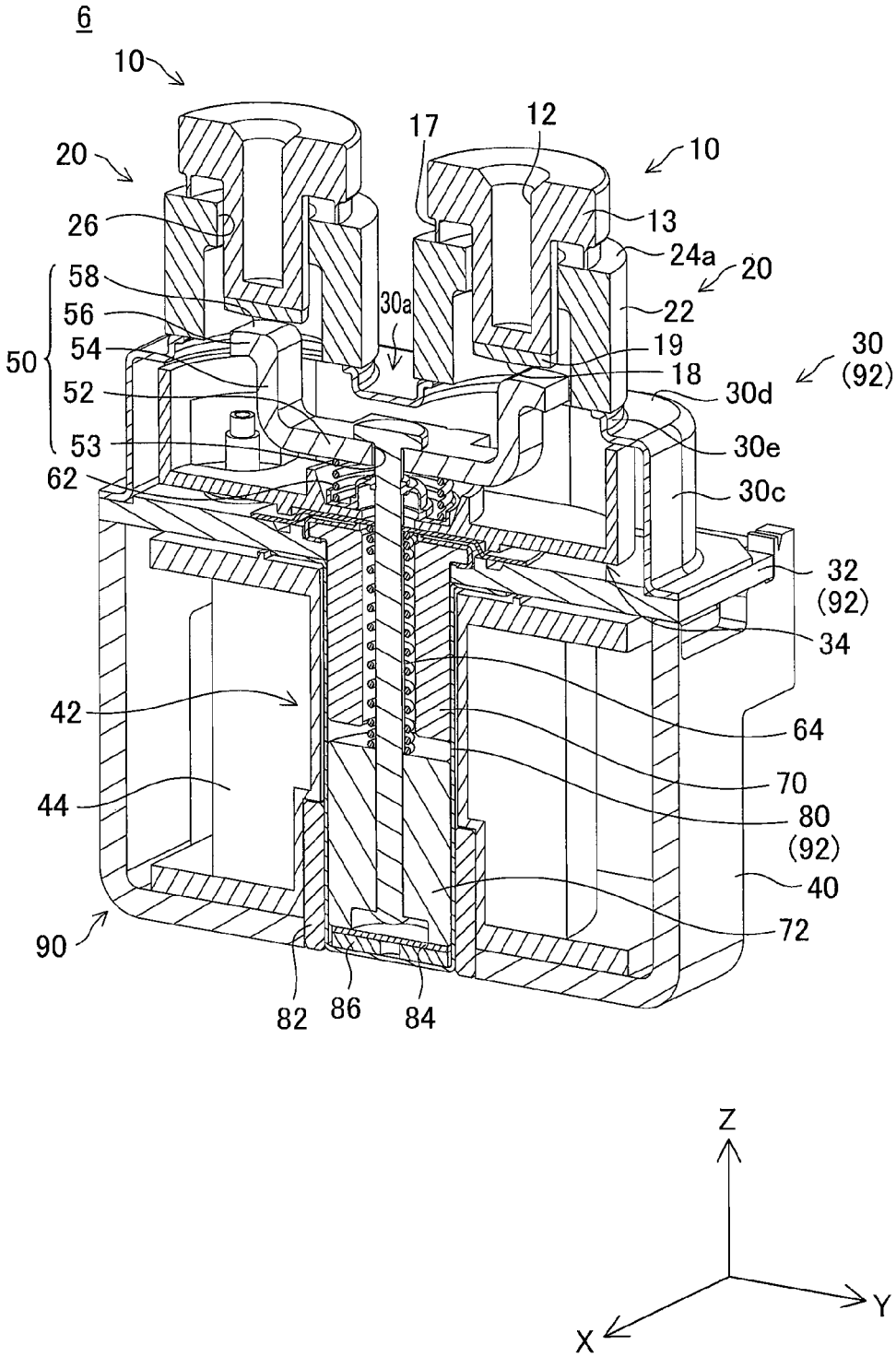
FIG. 4 is a perspective view of the relay main unit 6 shown in FIG. 3.
Figure 5:
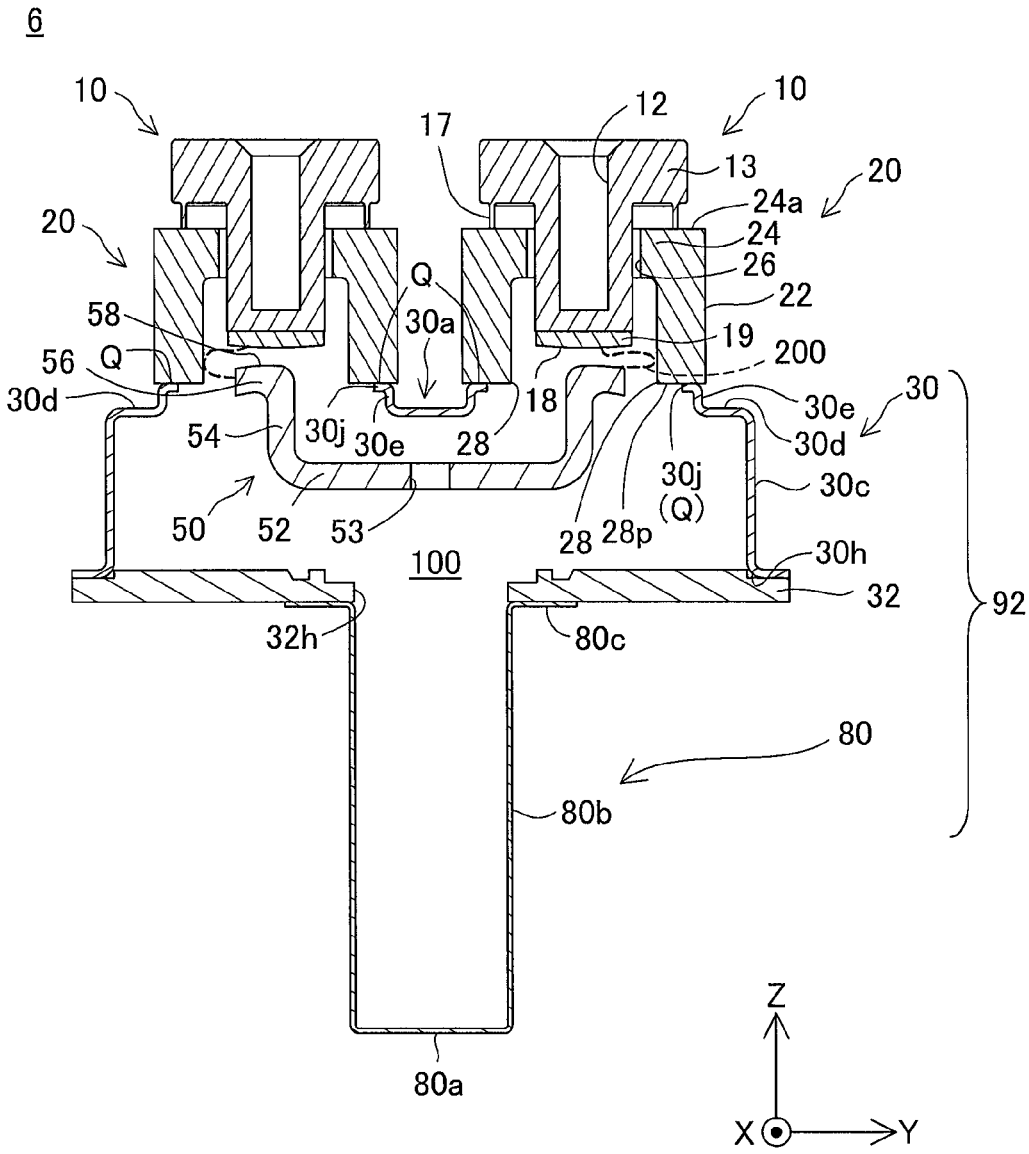
FIG. 5 is a diagram illustrating part of the cross section shown in FIG. 3.

FIG. 3 is a 3-3 cross sectional view of the relay main unit 6 shown in FIG. 2B. FIG. 4 is a perspective view of the relay main unit 6 shown in FIG. 3. FIG. 5 is a diagram illustrating part of the cross section shown in FIG. 3. As shown in FIGS. 3 and 4, the relay main unit 6 includes two fixed terminals 10, a movable contact member 50, a driving structure 90, two first vessels 20 and a second vessel 92 (FIG. 5). In FIGS. 3 to 5, the Z-axis direction is the vertical direction, the positive Z-axis direction is the upward direction, and the negative Z-axis direction is the downward direction. The same is applied to the other 3-3 cross sectional views.

Prior to detailed description of the respective component parts, the following describes an air-tight space 100 formed in the relay main unit 6, parts forming the air-tight space 100 and the movable contact member 50. As shown in FIG. 5, the air-tight space 100 is formed inside of the relay main unit 6 by the fixed terminals 10, the first vessels 20 and the second vessel 92.

The fixed terminals 10 are provided as members having electrical conductivity. The fixed terminals 10 are made of, for example, a copper-containing metal material. The fixed terminal 10 has a bottom and is formed in cylindrical shape. The fixed terminal 10 has a contact area 19 at the bottom on one end (negative Z-axis direction side). The contact area 19 may be made of the copper-containing metal material like the other parts of the fixed terminal 10 or may be made of a material having higher heat resistance (for example, tungsten) to protect from arc-induced damage. One face of the contact area 19 opposed to the movable contact member 50 forms a fixed contact 18 that comes into contact with the movable contact member 50. A flange 13 extended outward in the radial direction is formed on the other end (positive Z-axis direction side) of the fixed terminal 10.

Two first vessels 20 are provided corresponding to the fixed terminals 10. The first vessels 20 are provided as members having insulating properties. The first vessels 20 are made of a ceramic material, for example, alumina or zirconia, and have excellent heat resistance. The first vessel 20 has a bottom and is formed in cylindrical shape. More specifically, the first vessel 20 has a side face member 22 forming the side face of the first vessel 20, a bottom 24 and an opening 28 formed on one end opposed to the bottom 24 (i.e., side where the second vessel 92 is located). The bottom 24 has a through hole 26 formed to allow insertion of the fixed terminal 10. The flange 13 of each fixed terminal 10 is air-tightly joined with an outer surface 24*a* (surface exposed on the outside) of the bottom 24 of the corresponding first vessel 20. More specifically, the fixed terminal 10 is joined with the first vessel 20 by the following structure. One side face of the outer surface of the flange 13 opposed to the bottom 24 of the first vessel 20 has a diaphragm 17 formed to protect the joint between the fixed terminal 10 and the first vessel 20 from damage. The diaphragm 17 is formed to relieve the stress generated at the joint due to the thermal expansion difference between the fixed terminal 10 and the first vessel 20 made of different materials. The diaphragm 17 is formed in cylindrical shape having the larger inner diameter than that of the through hole 26. The diaphragm 17 is made of, for example an alloy like kovar and is bonded to the outer surface 24*a* of the first vessel 20 by brazing. For example, silver solder may be used for brazing. When the diaphragm 17 is provided as a separate body from the fixed terminal 10, the diaphragm 17 is also brazed to the flange 13 of the fixed terminal 10. Alternatively the diaphragm 17 may be formed integrally with the fixed terminal 10. The diaphragm 17 and the brazing part may be regarded as the joint between the fixed terminal 10 and the first vessel 20.

The second vessel 92 includes an iron core case 80 that has a bottom and is formed in cylindrical shape, a rectangular base 32 and a joint member 30 in approximately rectangular parallelepiped shape.

The joint member 30 is made of, for example, a metal material. A rectangular opening 30*h* is formed in one face (lower face) of the joint member 30. Two through holes 30*j* are formed in an upper face 30*a* that is opposed to the one face of the joint member 30. The joint member 30 also has a side face 30*c* arranged to connect the peripheral edge of the upper face 30*a* with the peripheral edge of the opening 30*h*. The upper face 30*a* includes a base section 30*d* that is approximately perpendicular to the moving direction of the movable contact member 50 and a bent section 30*e* that is extended from the base section 30*d* toward the first vessels 20. The through hole 30*j* is formed in the upper face 30*a* of the joint member 30. In other words, the through hole 30*j* is defined by the bent section 30*e*. The peripheral edge of the through hole 30*j* is air-tightly joined with an end face 28*p* that defines the opening 28 of the first vessel 20 by brazing that uses, for example, silver solder. The peripheral edge of the lower end with the opening 30*h* is air-tightly joined with the base 32 by, for example, laser welding or resistance welding.

The bent section 30*e* of the joint member 30 serves to relieve the stress applied to a joint area Q by the thermal expansion difference between the first vessel 20 and the base 32 as described above. More specifically, elastic deformation of the bent section 30*e* relieves the force in the radial direction applied to the joint area Q (especially the force applied to shift the joint area Q outward in the radial direction of the fixed terminal 10) by the thermal expansion difference between the joint member 30 and the first vessel 20 made of different materials. This reduces the possibility that the joint area Q is damaged.

The base 32 is a magnetic body and is made of a metal magnetic material, for example, iron. A through hole 32*h* is formed near the center of the base 32 to allow insertion of a fixed iron core 70 (FIG. 3) described later.

The iron core case 80 is a non-magnetic body. The iron core case 80 has a bottom and is formed in cylindrical shape. The iron core case 80 includes a circular bottom section 80*a*, a tubular section 80*b* in cylindrical shape extended upward from the outer edge of the bottom section 80*a*, and a flange section 80*c* extended outward from the upper end of the tubular section 80*b*. The whole circumference of the flange section 80*c* is air-tightly joined with the peripheral edge of the through hole 32*h* of the base 32 by, for example, laser welding.

The air-tight joint of the respective members 10, 20, 30, 32 and 80 as described above internally form the air-tight space 100. Hydrogen or a hydrogen-based gas is confined in the air-tight space 100 at or above the atmospheric pressure (for example, at 2 atm), in order to prevent heat generation of the fixed contact 18 and the movable contact 58 by electric arching. More specifically, after the joint of the respective members 10, 20, 30, 32 and 80, the air-tight space 100 is vacuumed via a vent pipe 69 arranged to communicate the inside with the outside of the air-tight space 100 shown in FIG. 3. After such vacuuming, the gas like hydrogen is confined to a predetermined pressure via the vent pipe 69 in the air-tight space 100. After the gas like hydrogen is confined at the predetermined pressure, the vent pipe 69 is caulked to prevent leakage of the gas like hydrogen from the air-tight space 100.

As shown in FIG. 5, each fixed contact 18 is placed inside the first vessel 20 in the air-tight space 100. The movable contact member 50 that moves to come into contact with and separate from the respective fixed contacts 18 (contact and separation) is placed in the air-tight space 100. The movable contact member 50 is placed in the air-tight space 100 and is arranged opposite to the two fixed terminals 10. The movable contact member 50 is a plate-like member having electrical conductivity. The movable contact member 50 is made of, for example, a copper-containing metal material.

The movable contact member 50 includes a center section 52, extended sections 54 and opposed sections 56. The center section 52 is extended in a direction that is perpendicular to the moving direction and is along from one fixed terminal 10 to the other fixed terminal 10 (referred to as Y-axis direction or simply as "horizontal direction"). The center section 52 is placed inside the second vessel 92 in the air-tight space 100. The shape of the center section 52 is not specifically limited and is, for example, plate-like shape or bar-like shape. The extended sections 54 are extended from both ends of the center section 52 toward the two fixed terminals 10. In other words, the extended sections 54 are extended in the direction including the moving direction component. A through hole 53 is formed near the center of the center section 52. A rod 60 (FIG. 3) described below is inserted through the through hole 53. The opposed section 56 is extended in the horizontal direction from one end of the extended section 54. An opposite surface of the opposed section 56 facing the fixed contact 18 forms the movable contact 58, which comes into contact with the fixed contact 18. The opposed section 56 is located below the fixed contact 18. The movable contact 58 is placed inside the first vessel 20 in the air-tight space 100 in the state furthest from the fixed contact 18. In other words, the movable contact 58 is always located inside the first vessel 20, irrespective of the movement (displacement) of the movable contact member 50. A contact area of the rear side of the center section 52 of the movable contact member 50 that comes into contact with a first spring 62 described below may have a cylindrical groove formed in a shape corresponding to the shape of the first spring 62 for the purpose of positioning the first spring 62.

The following describes the driving structure 90 with reference to FIG. 3. The driving structure 90 includes a rod 60, the base 32, the fixed iron core 70, a movable iron core 72, the iron core case 80, a coil 44, a coil bobbin 42, a coil case 40, a first spring 62 as an elastic member and a second spring 64 as another elastic member. In order to bring the respective movable contacts 58 into contact with the corresponding fixed contacts 18, the driving structure 90 moves the movable contact member 50 in a direction that the movable contacts 58 face the fixed contacts 18 (vertical direction, Z-axis direction). More specifically, the driving structure 90 moves the movable contact member 50 to bring the respective movable contacts 58 into contact with the corresponding fixed contacts 18 or to separate the respective movable contacts 58 from the corresponding fixed contacts 18.

The coil 44 is wound on the resin coil bobbin 42 in hollow cylindrical shape. The coil bobbin 42 includes a bobbin main body 42*a* in cylindrical shape extended in the vertical direction, an upper face 42*b* extended outward from the upper end of the bobbin main body 42*a* and a lower face 42*c* extended outward from the lower end of the bobbin main body 42*a*.

The coil case 40 is a magnetic body and is made of a metal magnetic material, for example, iron. The coil case 40 is formed in concave shape. More specifically, the coil case 40 includes a rectangular bottom section 40*a* and a pair of side face sections 40*b* extended upward (in the vertical direction) from the peripheral edges of the bottom section 40*a*. A through hole 40*h* is formed on the center of the bottom section 40*a*. The coil case 40 has the coil bobbin 42 placed inside thereof and surrounds the coil 44 to allow passage of magnetic flux. The coil case 40, in combination with the base 32, the fixed iron core 70 and the movable iron core 72, forms a magnetic circuit as described below.

The iron core case 80 has a disc-shaped rubber element 86 and a disc-shaped bottom plate 84 placed on the bottom section 80*a*. The iron core case 80 passes through inside of the bobbin main body 42*a* and the through hole 40*h* of the coil case 40. A cylindrical guide element 82 is placed between the lower end of the tubular section 80*b* and the coil case 40 and the coil bobbin 42. The guide element 82 is a magnetic body and is made of a metal magnetic material, for example, iron. The presence of the guide element 82 enables the magnetic force generated during energization of the coil 44 to be efficiently transmitted to the movable iron core 72.

The fixed iron core 70 is in columnar shape and includes a columnar main body 70*a* and a disc-shaped upper end 70*b* extended outward from the upper end of the main body 70*a*. A through hole 70*h* is formed along from the upper end to the lower end of the fixed iron core 70. The through hole 70*h* is formed near the center of the circular cross section of the main body 70*a* and the upper end 70*b*. Part of the fixed iron core 70 including the lower end of the main body 70*a* is placed inside the iron core case 80. The upper end 70*b* is arranged to be protruded on the base 32. A rubber element 66 is placed on the outer surface of the upper end 70*b*. An iron core cap 68 is additionally placed on the upper surface of the upper end 70*b* via the rubber element 66. The iron core cap 68 has a through hole 68*h* formed on its center to allow insertion of the rod 60. The iron core cap 68 has the peripheral edge joined with the base 32 by, for example, welding and works to prevent the fixed iron core 70 from moving upward.

The movable iron core 72 is in columnar shape and has a through hole 72*h* formed along from its upper end to lower end. A recess 72*a* having a larger inner diameter than the inner diameter of the through hole 72*h* is formed at the lower end. The through hole 72*h* communicates with the recess 72*a*. The movable iron core 72 is placed on the bottom section 80*a* of the iron core case 80 via the rubber element 86 and the bottom plate 84. The upper end face of the movable iron core 72 is arranged to be opposed to the lower end face of the fixed iron core 70. As the coil 44 is energized, the movable iron core 72 is attracted to the fixed iron core 70 and moves upward.

The second spring 64 is inserted through the through hole 70*h* of the fixed iron core 70. The second spring has one end that is in contact with the iron core cap 68 and the other end that is in contact with the upper end face of the movable iron core 72. The second spring 64 presses the movable iron core 72 in a direction that moves the movable iron core 72 away from the fixed iron core 70 (negative Z-axis direction, downward direction).

The first spring 62 is located between the movable contact member 50 and the fixed iron core 70. The first spring 62 presses the movable contact member 50 in a direction that moves the respective movable contacts 58 closer to the corresponding fixed contacts 18 (positive Z-axis direction, upward direction). A third vessel 34 is placed inside the joint member 30 in the air-tight space 100. The third vessel 34 is made of, for example, a synthetic resin material or a ceramic material and serves to prevent the arc generated between the fixed contact 18 and the movable contact 58 from coming into contact with an electrically conductive member (for example, the joint member 30 as described later). The third vessel 34 is formed in rectangular parallelepiped shape and includes a rectangular bottom face 31 and a side face 37 extended upward from the peripheral edge of the bottom face 31. The third vessel 34 also has a holder 33 vertically arranged in circular shape on the bottom face 31. A through hole 34*h* is also formed in the bottom face 31 to allow insertion of the rod 60. The first spring 62 has one end that is in contact with the center section 52 and the other end that is in contact with the bottom face 31 via an elastic material 95 (for example, rubber). The elastic material 95 is arranged in close contact with the outer surface of a shaft member 60*a* of the rod 60 and thereby prevents the particulates of the component part of the contact area 19 or the movable contact member 50 caused and scattered by the arc from entering the second spring 64. This reduces the possibility that the characteristics of the second spring 64 are affected. The first spring 62 corresponds to the "elastic member" described in Solution to Problem. The elastic member herein may be, for example, a coil spring, a resin spring or a bellows.

The rod 60 is a non-magnetic body. The rod 60 includes a columnar shaft member 60*a*, a disc-shaped one end portion 60*b* provided at one end of the shaft member 60*a* and an arc-shaped other end portion 60*c* provided at the other end of the shaft member 60*a*. The shaft member 60*a* is inserted through the through hole 53 of the movable contact member 50 to be freely movable in the vertical direction (moving direction of the movable contact member 50). The one end portion 60*b* is arranged on the other face of the center section 52 opposite to the face where the first spring 62 is placed in the state that the coil 44 is not energized. The other end portion 60*c* is located in the recess 72*a*. The other end portion 60*c* is also joined with the bottom of the recess 72*a*. The one end portion 60*b* restricts the movement of the movable contact member 50 toward the fixed terminals 10 by the second spring 64 in the state that the driving structure 90 is not operated (in the non-energized state). The other end portion 60*c* is used to move the rod 60 in conjunction with the movement of the movable iron core 72 in the state that the driving structure 90 is operated.

Figure 6:
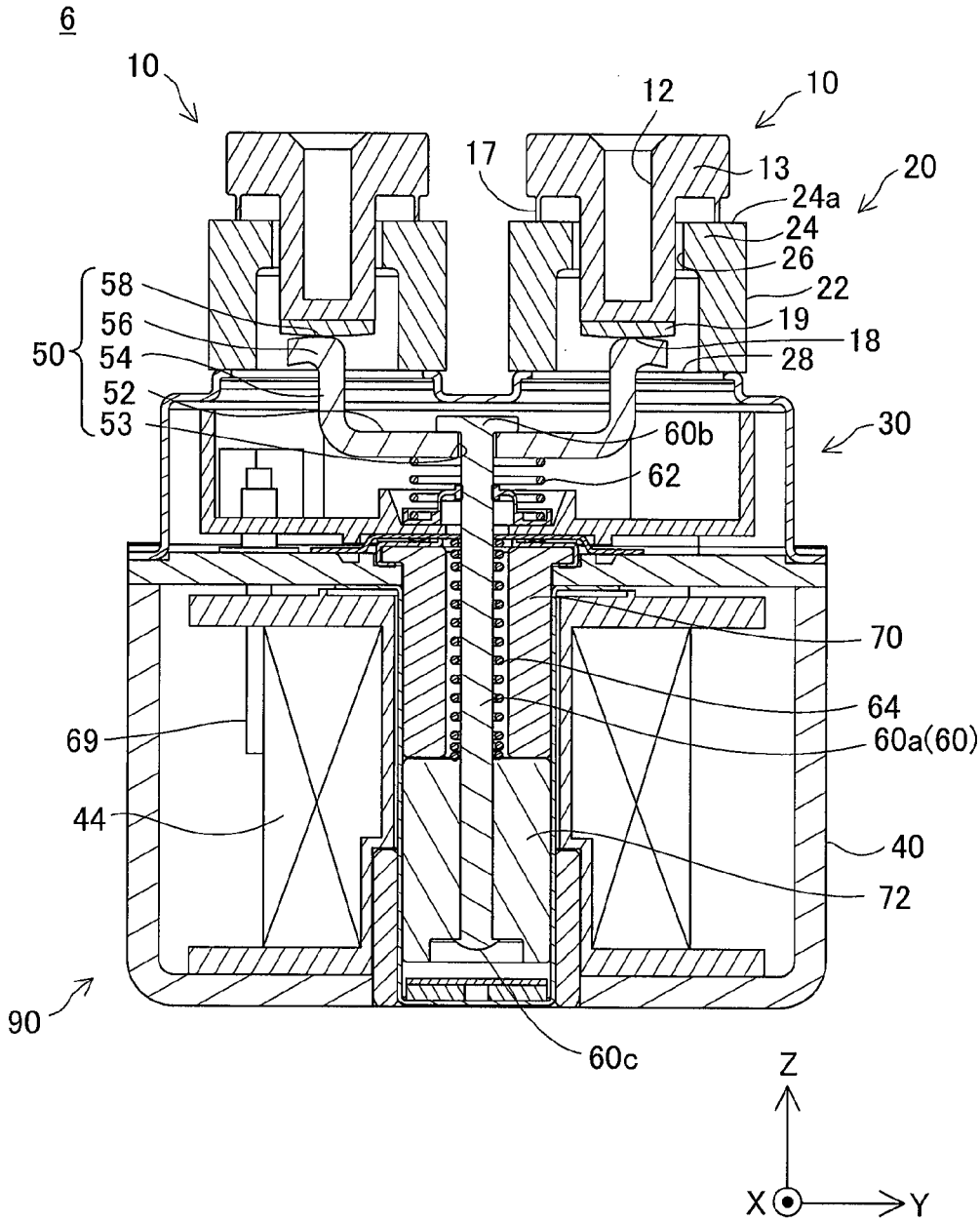
FIG. 6 is a 3-3 cross sectional view in the state that movable contacts 58 are in contact with fixed contacts 18.

The following describes the operations of the relay 5 with reference to FIG. 6. FIG. 6 is a 3-3 cross sectional view in the state that the respective movable contacts 58 are in contact with the corresponding fixed contacts 18. As the coil 44 is energized, the movable iron core 72 is attracted to the fixed iron core 70. The movable iron core 72 accordingly moves closer to the fixed iron core 70 against the pressing force of the second spring 64 to be in contact with the fixed iron core 70. As the movable iron core 72 moves upward, the rod 60 also moves upward. The one end portion 60*b* of the rod 60 accordingly moves upward. This eliminates the restriction on the movement of the movable contact member 50 and enables the movable contact member 50 to move upward (direction closer to the fixed contacts 18) by the pressing force of the first spring 62. As a result, the respective movable contacts 58 come into contact with the corresponding fixed contacts 18, so as to establish electrical continuity between the two fixed terminals 10 via the movable contact member 50.

When power supply to the coil 44 is cut off, on the other hand, the movable iron core 72 moves downward to be away from the fixed iron core 70 mainly by the pressing force of the second spring 64. The movable contact member 50 is then pressed by the one end portion 60*b* of the rod 60 to move downward (in the direction moving away from the fixed contacts 18). The respective movable contacts 58 are accordingly separated from the corresponding fixed contacts 18, so as to cut off the electrical continuity between the two fixed terminals 10. As described above, the energized state of the coil 44 (i.e., the state that the driving structure 90 is operated) represents the ON state of the relay 5, while the non-energized state of the coil 44 (i.e., the state that the driving structure 90 is not operated) represents the OFF state of the relay 5.

As described above, when the coil 44 is energized, the movable contact member 50 moves to establish electrical continuity between the two fixed terminals 10. When power supply to the coil 44 is cut off, the movable contact member 50 moves back to the original position to break the electrical continuity between the two fixed terminals 10. When the movable contact 58 is separated from the corresponding fixed contact 18, an arc is generated between the contacts 18 and 58. The generated arc is extended in the Y-axis direction to be extinguished by the permanent magnets provided on the outer casing 8 as shown by dotted lines 200 (FIG. 5).

As described above, the relay 5 of the first embodiment includes the plurality of fixed terminals 10, the movable contact member 50, the driving structure 90 operated to move the movable contact member 50 such that the respective movable contacts 58 of the movable contact member 50 come into contact with and separate from the corresponding fixed contacts 18 of the respective fixed terminals 10, the plurality of first vessels 20 provided corresponding to the respective fixed terminals 10 and arranged to have insulating properties, and the second vessel 92 joined with the plurality of first vessels 20, such that the second vessel 92 together with the plurality of fixed terminals 10 and the plurality of first vessels 20 internally form the air-tight space 100. The respective fixed contacts 18 are placed inside the corresponding first vessels 20 in the air-tight space 100. Each of the first vessels 20 has the opening 28 formed in one face (at one end) thereof to allow insertion of the movable contact member 50. The opening 28 is open toward the air-tight space 100. The driving structure 90 mainly includes the movable iron core 72 of the magnetic body, the coil 44 used to move the movable iron core 72, and the rod 60 inserted through the through hole 53 formed in the movable contact member 50 and arranged to have the one end portion 60*b* serving to restrict the movement of the movable contact member 50 and the other end portion 60*c* moving in conjunction with the movement of the movable iron core 72 to move the rod 60. Additionally, the driving structure 90 has the first spring 62 as the elastic member that presses the movable contact member 50 to move the movable contact member 50 toward the fixed terminals 10 when the restriction on the movement of the movable contact member 50 by the one end portion 60*b* is eliminated.

As described above, the relay 5 has the plurality of first vessels 20 provided corresponding to the respective fixed contacts 18. Even when electric arching causes and scatters the particulates of the component part of the fixed terminal 10, this structure enables the first vessels 20 to work as the barriers and thereby effectively reduces the possibility that the scattered particulates establish electrical continuity between the fixed terminals 10, compared with the structure using a single first vessel for the respective fixed contacts 18. This reduces the possibility of electrical continuity between the fixed terminals 10 in the OFF state of the relay 5 (i.e., the state that the driving structure 90 is not operated). Additionally, the respective fixed contacts 18 are placed inside the corresponding first vessels 20. Even when electric arching causes and scatters the particulates of the component part of the fixed terminal 10, the first vessels 20 effectively prevent the scattered particulates from spreading. This more effectively reduces the possibility that the scattered particulates establish electrical continuity between the fixed terminals 10. The plurality of first vessels 20 provided corresponding to the respective fixed contacts 18 reduce the possibility of electrical continuity between the fixed terminals 10 even when the fixed terminals 10 are arranged close to each other. This enables the plane of the relay 5 that is perpendicular to the moving direction of the movable contact member 50 to be downsized.

The joint member 30 is joined with the first vessels 20 by brazing at the end faces 28*p* that define the openings 28 of the first vessels 20 (FIG. 5). Compared with the structure that the joint member 30 is joined with the first vessels 20 at the inner circumferential faces of the first vessels 20, this structure reduces the possibility that the generated arc comes into contact with the brazing part (joint area Q) between the first vessel 20 and the joint member 30. This accordingly reduces the possibility that the brazing part (joint area Q) is damaged and thereby improves the durability of the relay 5.

The respective movable contacts 58 are located inside the first vessels 20, irrespective of the movement of the movable contact member 50. Even when electric arching causes and scatters the particulates of the component part of the movable contact member 50 including the movable contacts 58, this arrangement enables the first vessels 20 to work as the barriers and thereby more effectively reduces the possibility that the scattered particulates establish electrical continuity between the fixed terminals 10. This also more effectively reduces the possibility that the arc comes into contact with the brazing part (joint area Q) between the first vessel 20 and the joint member 30. This accordingly reduces the possibility that the brazing part (joint area Q) is damaged and thereby more effectively improves the durability of the relay 5.

The first vessel 20 has the bottom 24, and the fixed terminal 10 is joined with the first vessel 20 on the outer surface 24*a* of the bottom 24. The bottom 24 working as the barrier reduces the possibility that the generated arc comes into contact with the brazing part (joint area) between the fixed terminal 10 and the first vessel 20. This accordingly reduces the possibility that the brazing part is damaged and thereby more effectively improves the durability of the relay 5.

As an arc is generated between the contacts 18 and 58, the temperature of the air-tight space 100 rises to expand the gas in the air-tight space 100 and increase the internal pressure of the air-tight space 100. The members forming the air-tight space 100 (for example, the first vessels 20) are thus required to have pressure resistance. As described above, the plurality of first vessels 20 are provided corresponding to the plurality of fixed terminals 10. This structure enhances the pressure resistance of the first vessels 20, compared with the structure that a single first vessel 20 is provided for the plurality of fixed terminals 10. This accordingly reduces the possibility that the relay 5 is damaged. Additionally, the respective first vessels 20 formed in cylindrical shape have the enhanced pressure resistance, compared with the first vessels in rectangular prism shape. Even when the internal pressure of the air-tight space 100 is increased by electric arching, this reduces the possibility that the first vessel 20 is damaged and thereby more effectively improves the durability of the relay 5. It is not required that all the first vessels 20 are formed in cylindrical shape. The structure of forming at least one first vessel 20 in cylindrical shape enhances the pressure resistance, compared with the structure of forming all the first vessels 20 in rectangular prism shape.

The movable contact member 50 has the extended sections 54 (FIG. 5). The position where an arc is generated between the movable contact 58 and the fixed contact 18 is controllable by adjusting the length of the extended section 54. This reduces the possibility that the arc comes into contact with the joint area Q between the first vessel 20 and the joint member 30.

The movable contact member 50 also has the opposed sections 56 that are extended in the direction perpendicular to the moving direction (Y-axis direction in the first embodiment) (FIG. 6). This structure increases the volume of the movable contact member 50 in the vicinity of the movable contacts 58, compared with the structure without the opposed sections 56. The increased volume serves to quickly decrease the temperature of the opposed sections 56 heated by electric arching. More specifically, this structure enables the temperature of the opposed sections 56 heated by electric arching to be quickly decreased, without significantly increasing the weight of the movable contact member 50. Quickly decreasing the temperature of the opposed sections 56 reduces the wear of the opposed sections 56 that are opposed to the fixed contacts 18. In other words, this prevents the increase of the surface roughness of the movable contact 58 of the opposed section 56 and thereby prevents the increase in electrical contact resistance between the fixed contact 18 and the movable contact 58.

B. Second Embodiment

Figure 7:
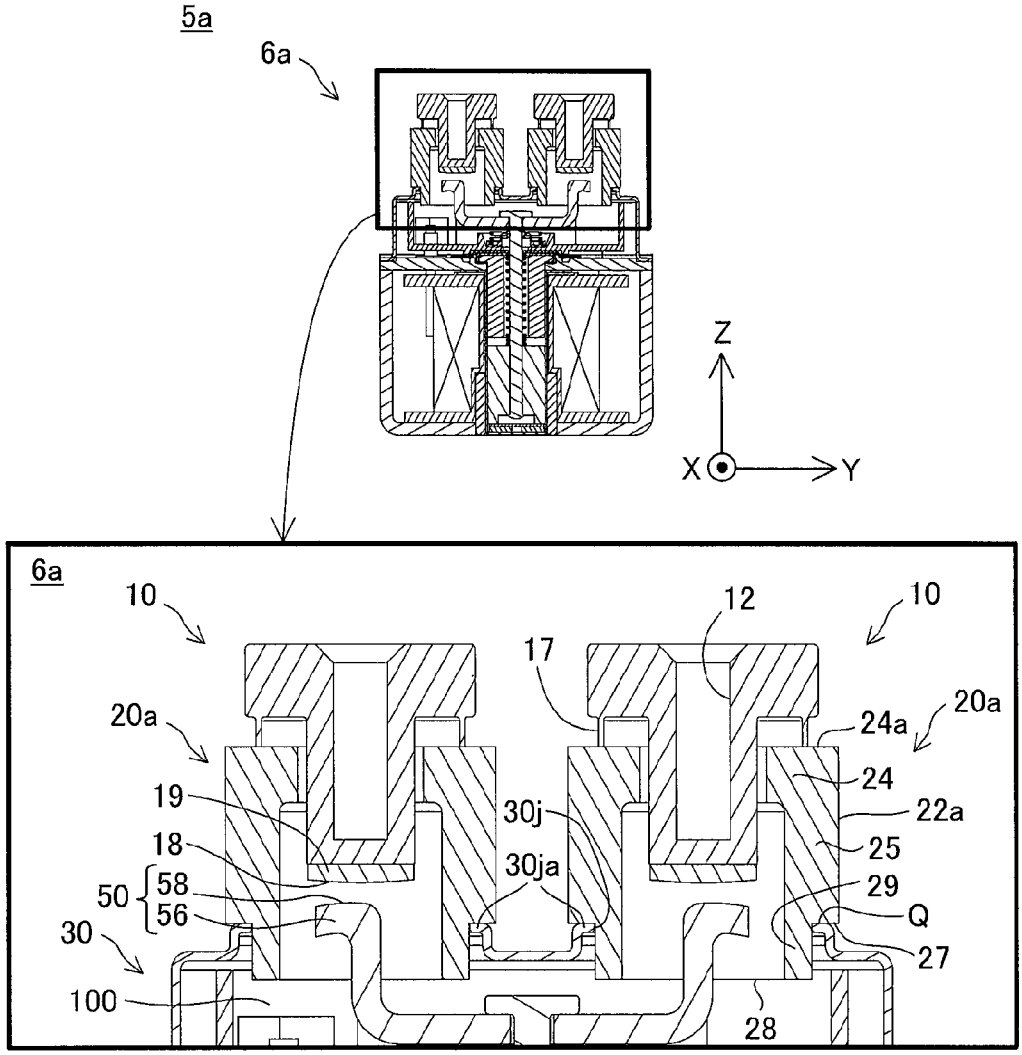
FIG. 7 is diagrams illustrating a relay according to a second embodiment.

FIG. 7 is diagrams illustrating a relay 5*a* according to a second embodiment. FIG. 7 includes a 3-3 cross sectional view and a partially enlarged 3-3 cross sectional view of a relay main unit 6*a* of the second embodiment. Like the first embodiment, the relay main unit 6*a* is surrounded and protected by the outer casing 8 (FIG. 2A). The differences from the relay main unit 6 of the first embodiment include the shape of first vessels 20*a* and the positions where the first vessels 20*a* are joined with the joint member 30. The other structure (for example, the driving structure 90) is similar to that of the first embodiment. The like parts are expressed by the like numerals or symbols and are not specifically described here.

The first vessel 20*a* has a side face member 22*a* including a thin-wall section 29 that has a smaller circumferential length of the outer surface (smaller outer diameter) than the other section. In other words, the side face member 22*a* includes the thin-wall section 29 of a fixed thickness vertically arranged from the peripheral edge of one face with the opening 28, and a thick-wall section 25 extended from the thin-wall section 29 in a direction opposed to the opening 28 (toward the bottom 24) to have a greater circumferential length of the outer surface than the thin-wall section 29. There is a step 27 as part of the outer peripheral surface of the first vessel 20*a* on the boundary between the thin-wall section 29 and the thick-wall section 25. The outer peripheral surface herein means the outer surface of a member that forms the side face and represents the outer surface of the side face member 22*a* of the first vessel 20*a* according to this embodiment. A peripheral edge 30*ja* of the joint member 30 that defines the through hole 30*j* is air-tightly joined with the step 27 by brazing. In other words, the joint area Q where the joint member 30 is joined with the first vessel 20*a* is located across the first vessel 20*a* from the fixed contact 18 and the movable contact 58. This means that the joint area Q is at the position hidden (unviewable) from the fixed contact 18 and the movable contact 58 by the first vessel 20*a*.

As described above, in the relay main unit 6 of the second embodiment, the joint member 30 is joined with the step 27 that is part of the outer peripheral surface of the first vessel 20*a*. This structure more effectively reduces the possibility that the arc generated between the fixed contact 18 and the movable contact 58 comes into contact with the joint area Q between the first vessel 20*a* and the joint member 30. This accordingly reduces the possibility that the joint area Q as the brazing part is damaged and thereby more effectively improves the durability of the relay 5. Like the first embodiment, in the second embodiment, the plurality of first vessels 20*a* are provided corresponding to the respective fixed contacts 18, and the respective fixed contacts 18 are placed inside the corresponding first vessels 20*a*. Even when electric arching causes and scatters the particulates of the component part of, for example, the fixed terminal 10, this structure reduces the possibility that the scattered particulates establish electrical continuity between the fixed terminals 10.

C. Third Embodiment

Figure 8:
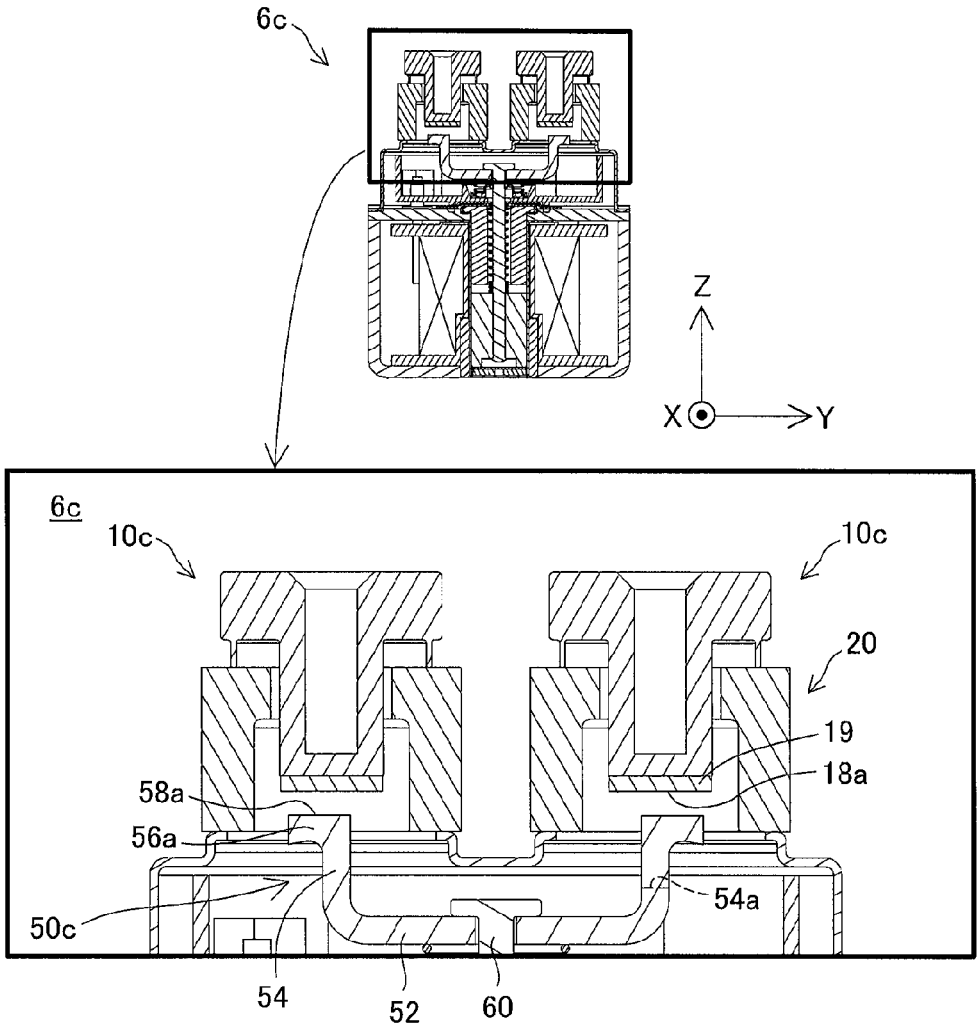
FIG. 8 is diagrams illustrating a relay according to a third embodiment.

FIG. 8 is diagrams illustrating a relay according to a third embodiment. FIG. 8 includes a 3-3 cross sectional view and a partially enlarged 3-3 cross sectional view of a relay main unit 6*c*. Like the first embodiment, the relay main unit 6*c* is surrounded and protected by the outer casing 8 (FIG. 2A). The differences from the relay main unit 6 of the first embodiment include fixed contacts 18*a* of fixed terminals 10*c* and movable contacts 58*a* of a movable contact member 50*c*. The other structure (for example, the driving structure 90) is similar to that of the first embodiment. The like parts are expressed by the like numerals or symbols and are not specifically described here. As shown in FIG. 8, the fixed contacts 18*a* form a plane that is perpendicular to the moving direction (Z-axis direction) of the movable contact member 50*c*. The movable contact member 50*c* has opposed sections 56*a*. The opposed section 56*a* is extended from an extended section 54 in a direction approximately parallel to the fixed contact 18*a*. An opposite surface of the opposed section 56*a* facing the fixed contact 18*a* is parallel to the fixed contact 18*a* and forms the movable contact 58*a* that comes into contact with the fixed contact 18*a*. The area of the movable contact 58*a* is smaller than the area of the fixed contact 18*a*. As the coil 44 is energized, the whole area of the movable contact 58*a* comes into contact with the fixed contact 18*a*. The area of the movable contact 58*a* is larger than the cross sectional area of a cut plane 54*a* of the extended section 54 that is the plane parallel to the fixed contact 18*a* (i.e., plane perpendicular to the moving direction of the movable contact member 50*c*).

As described above, in the relay main unit 6*c* of the third embodiment, the movable contact member 50*c* has the opposed sections 56*a*. Compared with the structure without the opposed sections 56*a*, this structure increases the contact area between the fixed contact 18*a* and the movable contact 58*a* and thereby advantageously decreases the contact resistance between the contacts 18*a* and 58*a*. This reduces heat generation between the contacts 18*a* and 58*a* in the contact state and thereby reduces the possibility that the fixed contact 18*a* and the movable contact 58*a* are molten and adhere to each other. Like the first embodiment, in the relay main unit 6*c* of the third embodiment, the plurality of first vessels 20 are provided corresponding to the respective fixed contacts 18*a*, and the respective fixed contacts 18*a* are placed inside the corresponding first vessels 20. Even when electric arching causes and scatters the particulates of the component part of, for example, the fixed terminal 10*c*, this structure reduces the possibility that the scattered particulates establish electrical continuity between the fixed terminals 10*c*.

D. Fourth Embodiment

Figure 9:
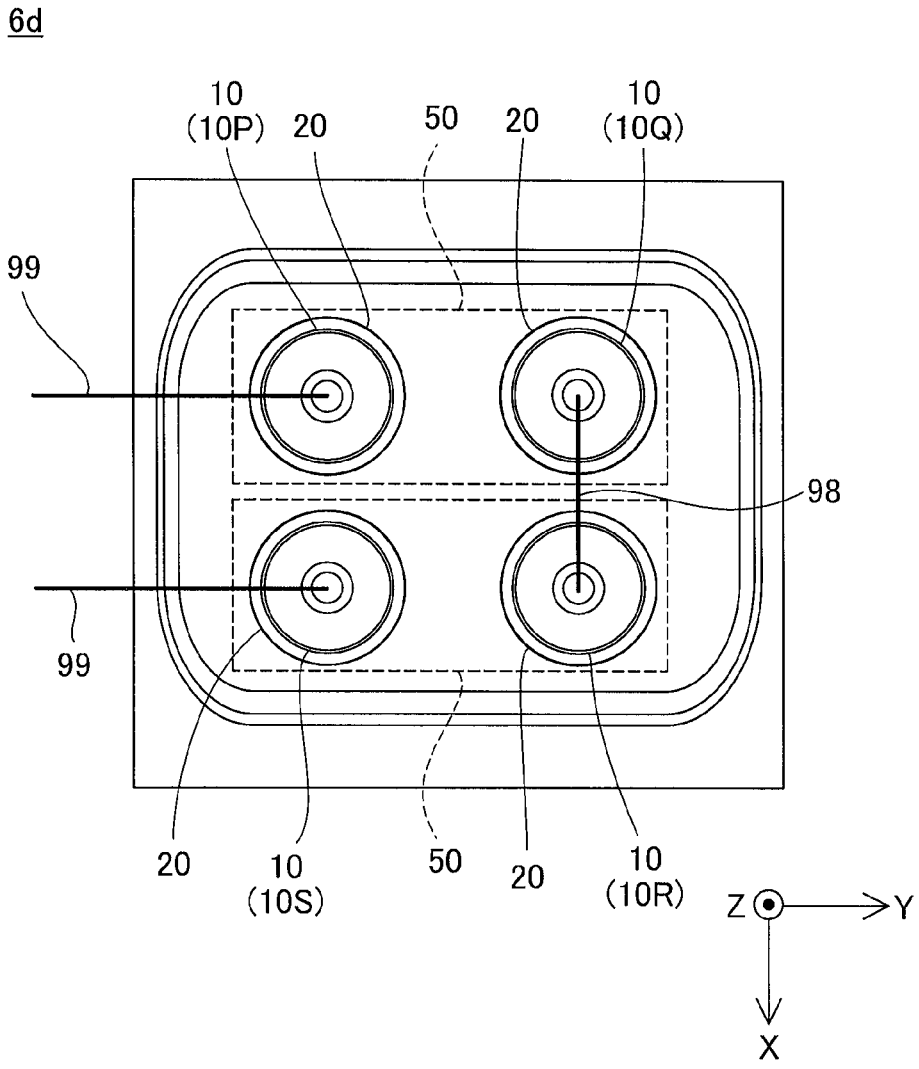
FIG. 9 is a diagram illustrating a relay main unit 6*d* according to a fourth embodiment.

FIG. 9 is a diagram illustrating a relay main unit 6*d* according to a fourth embodiment. FIG. 9 is a top view of the relay main unit 6*d* viewed from the positive Z-axis direction (directly above). Like the first embodiment, the relay main unit 6*d* is surrounded and protected by the outer casing 8 (FIG. 2A). The differences from the first embodiment include the number of fixed terminals 10, the number of first vessels 20, the number of movable contact members 50 and the structure of driving structures operated to drive the movable contact members 50. The other structure is similar to that of the first embodiment. The like parts are expressed by the like numerals or symbols and are not specifically described here. For convenience of explanation, the plurality of fixed terminals 10 are shown by additional symbols 10P, 10Q, 10R and 10S in parentheses for the purpose of differentiation.

The relay main unit 6*d* includes four fixed terminals 10 respectively having fixed contacts, two movable contact members 50 respectively having movable contacts opposed to the respective fixed contacts, and four first vessels 20 provided corresponding to the respective fixed terminals 10 and arranged to have insulating properties. The relay main unit 6*d* also includes two driving structures operated to individually drive the two movable contact members 50. The main structure of the two driving structures is similar to the structure of the driving structure 90 of the first embodiment (FIG. 3). The two driving structures share the base 32, the iron core case 80, the coil 44, the coil bobbin 42 and the coil case 40 but individually have the rod 60, the fixed iron core 70, the movable iron core 72, the first spring 62 and the second spring 64.

One fixed terminal 10P of two fixed terminals 10P and 10Q that are arranged to come into contact with and separate from one movable contact member 50 is electrically connected with wire 99 of the electric circuit 1 (FIG. 1). The other fixed terminal 10Q is electrically connected by wire 98 with one fixed terminal 10R of two fixed terminals 10R and 10S that are arranged to come into contact with and separate from the other movable contact member 50. The other fixed terminals 10S is electrically connected with the wire 99 of the electric circuit 1. When the relay is turned ON, the plurality of (four) fixed terminals 10P to 10S are thus electrically connected in series via the two movable contact members 50.

As described above, the relay main unit 6*d* of the fourth embodiment can decrease the voltage between each pair of the fixed contact and the movable contact, compared with the structure of the above embodiment. This reduces an arc energy (flow current) generated between the fixed contact and the movable contact and reduces a potential trouble caused by electric arching, for example, the possibility that the fixed contact and the movable contact adhere to each other by the heat caused by electric arching.

E. Fifth Embodiment

Figure 10:
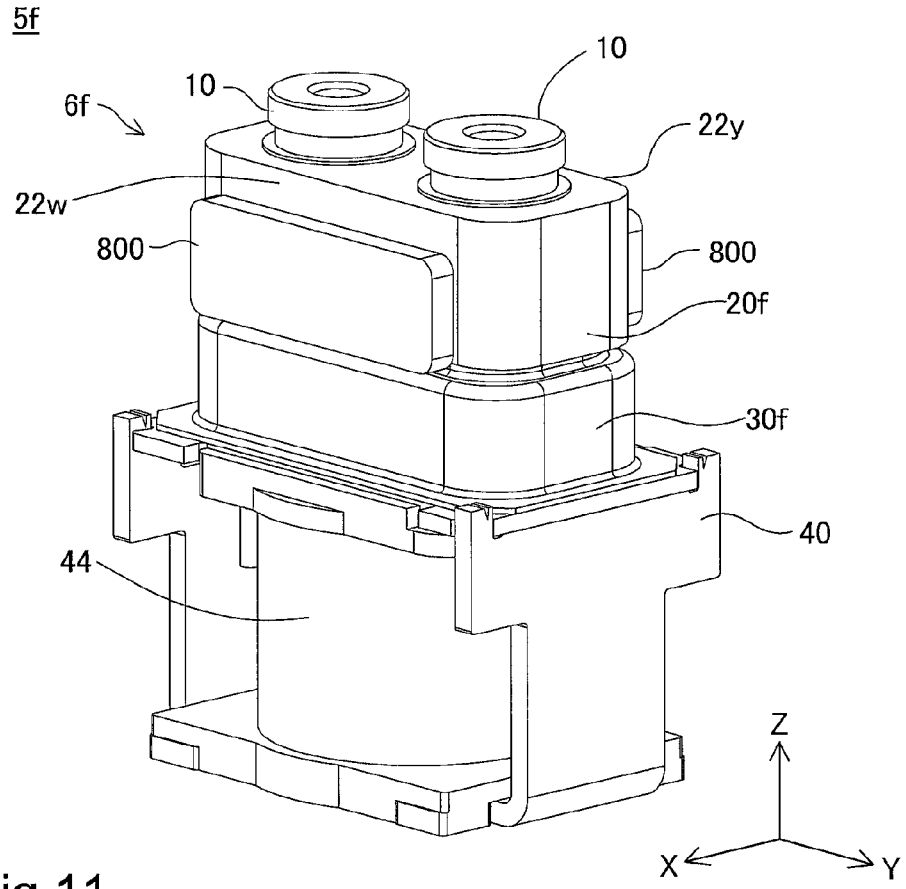
FIG. 10 is an appearance perspective view illustrating a relay 5*f* according to a fifth embodiment.

FIG. 10 is an appearance perspective view illustrating a relay 5*f* according to a fifth embodiment. The outer casing 8

Figure 11:
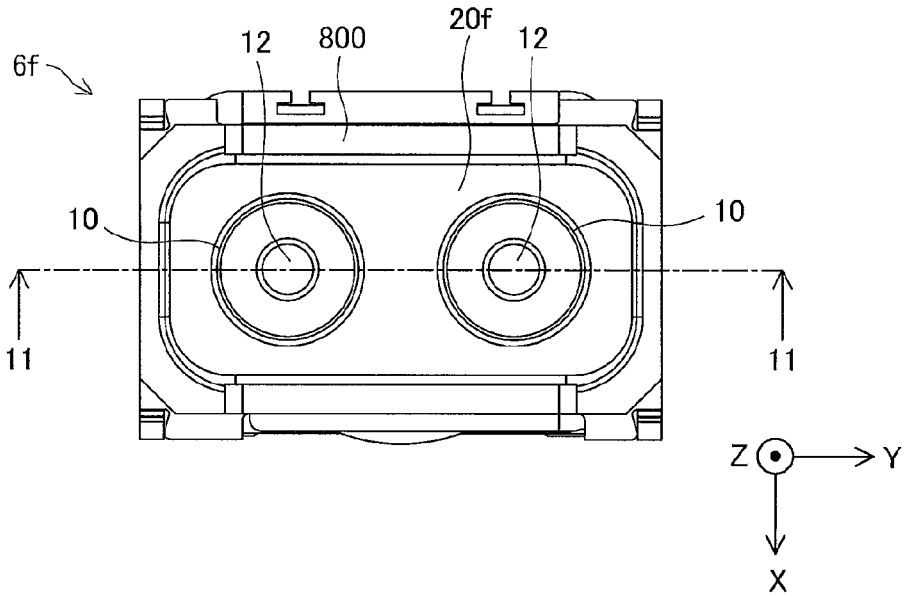
FIG. 11 is an appearance diagram illustrating a relay main unit 6*f* and magnets 800 according to the fifth embodiment.

(FIG. 2A) is omitted from the illustration. FIG. 11 is an appearance diagram illustrating a relay main unit 6*f* and magnets 800 according to the sixth embodiment. FIG. 11 is a view showing the relay 5*f* of FIG. 10 viewed from the positive Z-axis direction. The differences from the relay 5 of the first embodiment include the shapes of a first vessel 20*f* and a joint member 30*f*. The other structure is similar to that of the relay 5 of the first embodiment. The like parts are expressed by the like numerals or symbols and are not specifically described here.

As shown in FIG. 10, the relay main unit 6*f* includes a first vessel 20*f*. Only one first vessel 20*f* is provided in this structure. Like the first embodiment, the first vessel 20*f* is made of a material having insulating properties (for example, ceramic material). Like the first embodiment, the relay 5*f* has permanent magnets 800 that work to extinguish an arc generated between the fixed contact and the movable contact that face each other. More specifically, the relay 5*f* has a pair of permanent magnets 800. The pair of permanent magnets 800 are placed outside the first vessel 20*f* to be opposed to each other across an air-tight space in the relay 5*f*. More specifically, the pair of permanent magnets 800 are placed outside the first vessel 20*f* to be opposed to each other across the pair of movable contacts that are located in the air-tight space. The pair of permanent magnets 800 are arranged along a direction that the pair of fixed terminals 10 face each other (Y-axis direction). As shown in FIG. 11, the pair of permanent magnets 800 are arranged to have faces of different polarities opposed to each other across the air-tight space.

Figure 12:
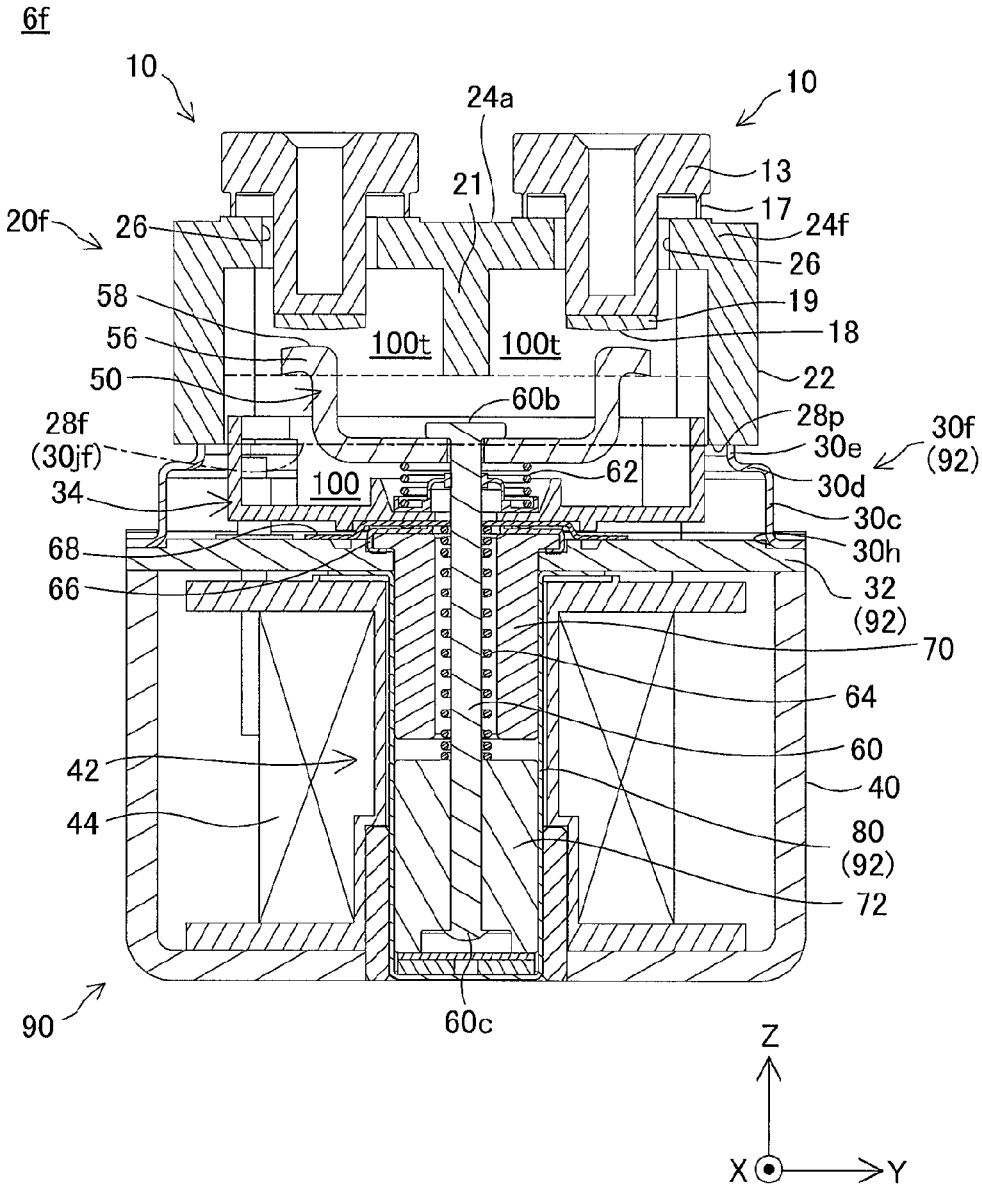
FIG. 12 is an 11-11 cross sectional view of FIG. 11.

FIG. 12 is an 11-11 cross sectional view of FIG. 11. The first vessel 20*f* includes a bottom 24*f* and an opening 28*f* opposed to the bottom 24. Like the first embodiment, the bottom 24*f* has through holes 26 formed to allow insertion of the fixed terminals 10. The through holes 26 are formed corresponding to the number of the fixed terminals 10. Two through holes 26 are formed in the bottom 24*f* according to this embodiment. For the better understanding, the opening 28*f* is shown by the dash-dot line.

Like the first embodiment, the joint member 30*f* is made of, for example, a metal material. One side of the joint member 30*f* facing the first vessel 20*f* has an opening 30*jf*. The opening 30*jf* is formed corresponding to the number of the first vessel 20*f*. More specifically, the joint member 30*f* has one opening 30*jf* according to this embodiment. An end face of a bent section 30*e* that defines the opening 30*jf* of the joint member 30*f* and an end face 28*p* that defines the opening 28*f* of the first vessel 20*f* are air-tightly joined with each other by brazing that uses, for example, silver solder.

The fixed terminal 10 is inserted through the through hole 26 of the first vessel 20*f*. More specifically, the fixed terminal 10 passes through the through hole 10, such that the fixed contact 18 located at one end (negative Z-axis direction side) of the fixed terminal 10 is placed inside the first vessel 20*f* and the flange 13 located at the other end (positive Z-axis direction side) of the fixed terminal 10 is placed outside the first vessel 20*f*. Like the first embodiment, the diaphragms 17 are joined with an outer surface 24*a* of the bottom 24*f* by brazing. As described above, the first vessel 20*f* has the bottom 24*f* and the opening 28*f* opposed to the bottom 24*f*, and the pair of fixed terminals 10 are inserted through and attached to the bottom 24*f*, such that the pair of fixed contacts 18 are placed inside the first vessel 20*f* and the flanges 13 are placed outside the first vessel 20*f*.

The first vessel 20*f* has a plurality of chambers 100*t* formed corresponding to the plurality of fixed terminals 10. According to this embodiment, the first vessel 20*f* has two chambers 100*t* internally formed corresponding to the two fixed terminals 10. The two chambers 100*t* are parted from each other by a partition wall member 21. More specifically, the two chambers 100*t* are formed by the partition wall member 21 and a side face member 22 of the first vessel 20*f*. For the better understanding, the lower openings of the two chambers 100*t* are shown by the dotted line. The partition wall member 21 is integrally formed with the other part of the first vessel 20*f* (for example, the bottom 24*f*). The partition wall member 21 is extended in the direction of the pair of fixed terminals 10 facing each other along a first side face section 22*w* and a second side face section 22*y* across the pair of fixed terminals 10 (FIG. 10) out of the side face member 22 of the first vessel 20*f*.

The partition wall member 21 is extended from the bottom 24*f* to a position further away from the bottom 24*f* than at least the position where the plurality of fixed contacts 18 are located, with respect to the moving direction of the movable contact member 50 (Z-axis direction, vertical direction). According to this embodiment, the partition wall member 21 is extended from the bottom 24*f* to the position further away from the bottom 24*f* than the position where the plurality of movable contacts 58 are located, with respect to the moving direction of the movable contact member 50. With respect to the moving direction of the movable contact member 50 (vertical direction, Z-axis direction), the direction that moves the movable contact member 50 closer to the fixed terminals 10 is set to the upward direction (vertically upward direction, positive Z-axis direction), and the direction that moves the movable contact member 50 away from the fixed terminals 10 is set to the downward direction (vertically downward direction, negative Z-axis direction). According to this embodiment, the partition wall member 21 is extended from the bottom 24*f* to the position below the movable contacts 58, with respect to the moving direction of the movable contact member 50.

Extending the partition wall member 21 from the bottom 24*f* to the predetermined position causes the respective fixed contacts 18 to be located inside the respective chambers 100*t* in the air-tight space 100. The respective movable contacts 58 are also located inside the respective chambers 100*t* in the air-tight space 100. More specifically, the respective movable contacts 58 are always located inside the respective chambers 100*t*, irrespective of the movement (displacement) of the movable contact member 50. According to the embodiment, the partition wall member 21 is located between the pair of fixed contacts 18 and between the pair of movable contacts 58. In other words, the respective fixed contacts 18 are arranged at the positions across the partition wall member 21. The respective movable contacts 58 are also arranged at the positions across the partition wall member 21.

As described above, the relay 5*f* of the fifth embodiment includes the first vessel 20*f* that has the plurality of chambers 100*t* formed corresponding to the plurality of fixed terminals 10 (FIG. 12). The plurality of chambers 100*t* are parted from each other by the partition wall member 21 in the first vessel 20*f*. The partition wall member 21 is extended from the bottom 24*f* to the position further away from the bottom 24*f* than the position where the movable contacts 58 are located, with respect to the moving direction of the movable contact member 50. In other words, the respective fixed contacts 18 and the respective movable contacts 58 are located inside the corresponding chambers 100*t* in the air-tight space 100. Even when electric arching causes and scatters the particulates of the component part of the fixed terminal 10, this structure enables the partition wall member 21 of the first vessel 20*f* to work as the barrier and thereby effectively reduces the possibility that the particulates are accumulated to establish electrical continuity between the fixed terminals 10. The movable contacts 58, as well as the fixed contacts 18, are located inside the respective chambers 100*t*. Even when electric arching causes and scatters the particulates of the component part of the movable contact member 50 including the movable contacts 58, this structure enables the partition wall member 21 of the first vessel 20*f* to work as the barrier. This more effectively reduces the possibility that the particulates are accumulated to establish electrical continuity between the fixed terminals 10.

F. Sixth Embodiment

Figure 13:
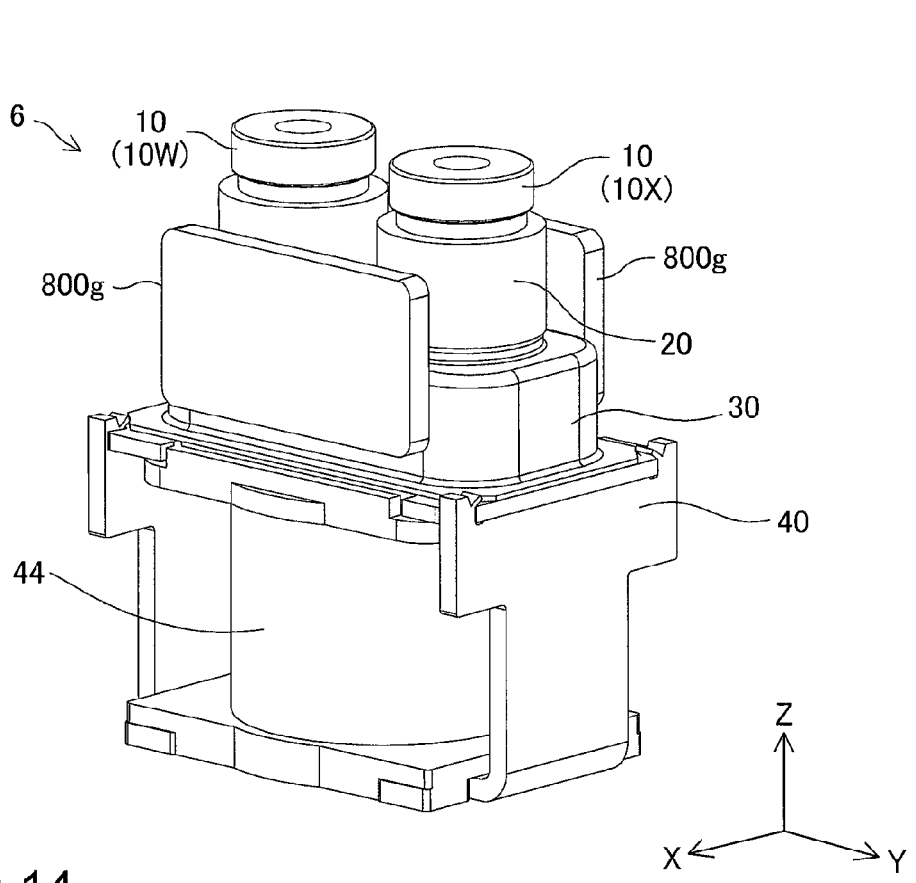
FIG. 13 is an appearance perspective view illustrating a relay 5*g* according to a sixth embodiment.
Figure 14:
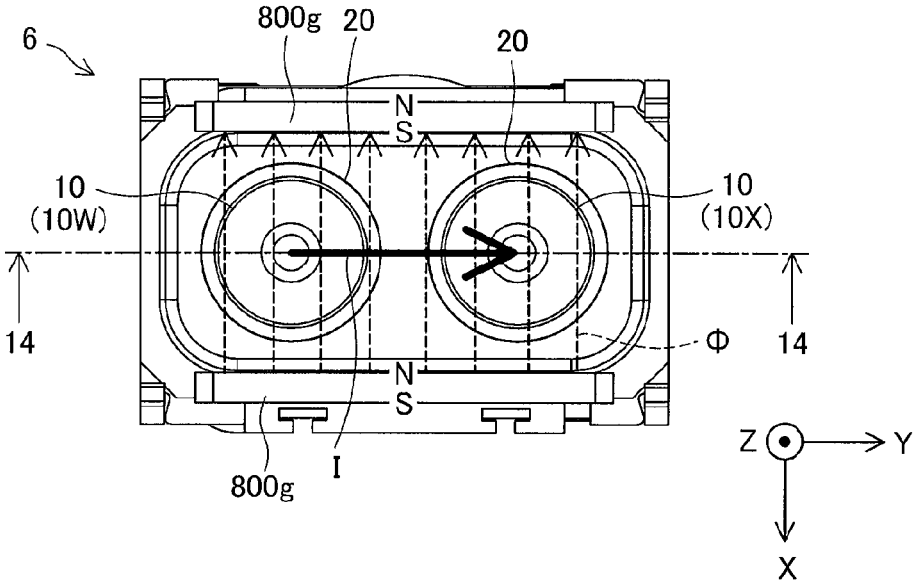
FIG. 14 is a view showing the relay 5*g* of FIG. 13 viewed from the positive Z-axis direction.
Figure 15:
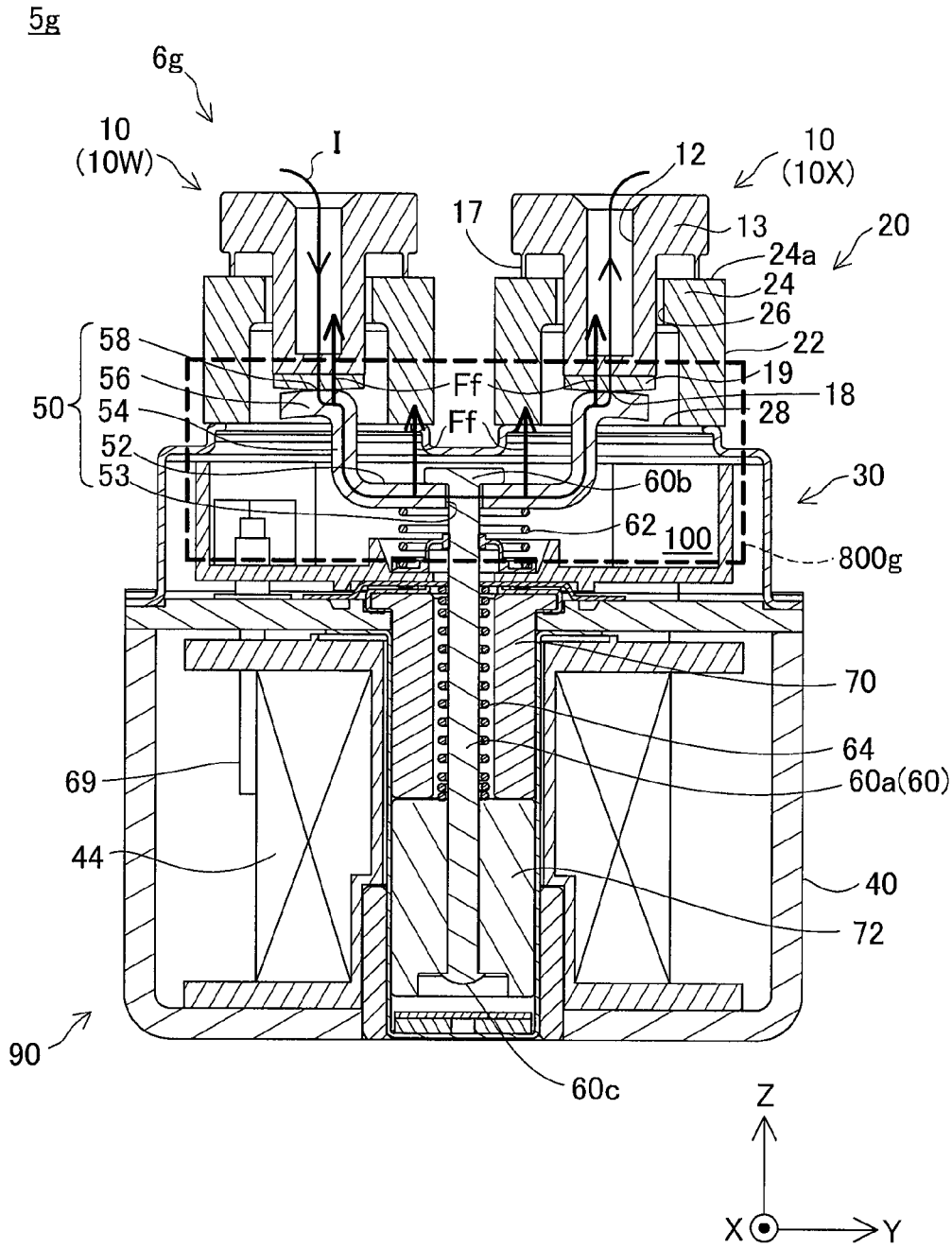
FIG. 15 is a 14-14 cross sectional view of FIG. 14.

FIG. 13 is an appearance perspective view illustrating a relay 5*g* according to a sixth embodiment. The outer casing 8 (FIG. 2A) is omitted from the illustration. FIG. 14 is a view showing the relay 5*g* of FIG. 13 viewed from the positive Z-axis direction. FIG. 15 is a 14-14 cross sectional view of FIG. 14. For the purpose of clearly specifying the positions of permanent magnets 800*g*, the outline of the permanent magnet 800*g* is shown by the dotted line in FIG. 15. A preferable application of the permanent magnets 800*g* according to the sixth embodiment is described below. The difference from the relay 5 of the first embodiment is the structure of the permanent magnets 800*g*. The other structure (for example, the relay main unit 6) is similar to that of the first embodiment. The like parts are expressed by the like numerals or symbols and are not specifically described here.

The relay 5*g* of the sixth embodiment is applied to the electric circuit 1 (also called "system") that uses a secondary battery as the DC power source 2 (FIG. 1). In other words, the relay 5*g* is used for the system 1 including a secondary battery. The system 1 includes a load, such as the motor 4. According to this embodiment, during discharge of the secondary battery 2, one of the pair of fixed terminals 10 which the electric current flows in is called positive fixed terminal 10W, and the other which the electric current flows out is called negative fixed terminal 10X. When the secondary battery is used for the DC power source 2, the system 1 may be configured to charge the regenerative energy of the motor 4 into the secondary battery. In this application, the system 1 is equipped with a converter that converts AC power into DC power. According to the other embodiments and modifications, when the secondary battery is used for the DC power source 2, the system 1 includes a converter in addition to the inverter 3. The relay 5*g* of the sixth embodiment is not limitedly applied to the system 1 that uses the secondary battery for the DC power source 2 but is also applicable to a system that includes any of various power sources, such as a primary battery or a fuel cell, in addition to the secondary battery and the load 4. During power supply from the DC power source 2 to the load 4, one of the pair of fixed terminals 10 which the electric current flows in works as the positive fixed terminal 10W, and the other which the electric current flows out works as the negative fixed terminal 10X.

As shown in FIG. 13, the relay 5*g* has the pair of permanent magnets 800*g*. Like the first embodiment, the pair of permanent magnets 800*g* are used to extinguish an arc generated between the fixed contact and the movable contact facing each other. Additionally, during discharge of the secondary battery 2 (FIG. 1), when electric current flows in the relay 5*g*, the pair of permanent magnets 800*g* work to generate the Lorentz force acting on the electric current flowing through the movable contact member in the direction that moves the movable contact member closer to the opposed fixed contacts. The details will be described later.

The pair of permanent magnets 800*g* are located outside of the first vessel 20 and the joint member 30 to be opposed to each other across the air-tight space 100 in the relay 5*g*. More specifically, as shown in FIG. 15, the pair of permanent magnets 800*g* are arranged to face each other across the movable contact member 50 in the air-tight space 100. Like the other embodiments, the pair of permanent magnets 800*g* are arranged along the direction that the pair of fixed terminals 10 face each other (Y-axis direction) as shown in FIG. 13. As shown in FIG. 14, the pair of permanent magnets 800*g* are arranged to have faces of different polarities opposed to each other across the air-tight space 100. According to this embodiment, the pair of permanent magnets 800*g* are arranged to form a magnetic flux $\phi$, which generates the Lorentz force acting on the electric current I flowing through the movable contact member 50 in the direction that moves the movable contact member 50 closer to the opposed fixed contacts 18, during discharge of the secondary battery 2. More specifically, the pair of permanent magnets 800*g* are arranged to form the magnetic flux $\phi$ from the positive X-axis direction side to the negative X-axis direction side in the air-tight space 100.

As shown in FIG. 15, the pair of permanent magnets 800*g* are placed in the area where the movable contact member 50 is located at least in the state that the movable contact member 50 is in contact with the fixed terminals 10, with respect to the moving direction of the movable contact member 50. When the secondary battery 2 (FIG. 1) is discharged in the energized state of the coil 44 (in the ON state of the relay 5*g*), the electric current I flows in the sequence of the positive fixed terminal 10W, the movable contact member 50 and the negative fixed terminal 10X. The permanent magnets 800*g* then generate the Lorentz force Ff acting on the electric current flowing in a predetermined direction out of the electric current I flowing through the movable contact member 50 in the direction that moves the movable contact member 50 closer to the opposed fixed contacts 18. The electric current flowing in the predetermined direction herein means the electric current flowing in the direction that the pair of fixed terminals 10 establishing electrical continuity by the movable contact member 50 face each other, i.e., in the direction from the positive fixed terminal 10W to the negative fixed terminal 10X (positive Y-axis direction).

As described above, in the relay 5*g* of the sixth embodiment, the permanent magnets 800*g* are arranged to generate the Lorentz force (electromagnetic adsorption) in the direction that moves the movable contact member 50 closer to the opposed fixed contacts 18 when the electric current flows in the relay 5*g* during power supply from the DC power source 2 as the power supply to the motor 4 as the load (FIG. 15). This stably maintains contact between the movable contacts 58 and the fixed contacts 18 opposed to each other. The generation of electromagnetic adsorption advantageously reduces the required force (pressing force) of the first spring 62 to be applied to the movable contact member 50 to bring the contacts 18 and 58 of the relay 5*g* into contact with each other by a predetermined force (for example, 5 N). This results in reducing the required force (pressing force) of the second spring 64 to separate the movable contact member 50 from the fixed terminals 10 against the pressing force of the first spring 62. Such reduction of the required pressing force of the second spring 64 reduces the required force to move the movable contact member 50 closer to the fixed terminals 10 against the pressing force of the second spring 64. This reduction is equivalent to reducing the required force to move the movable iron core 72 and thereby decreases the number of winds of the coil 44. This more effectively prevents size expansion of the relay 5*g* and reduces the power consumption. Especially when high current flows from the DC power source 2 to the load such as the motor 4, the increased electromagnetic adsorption is generated to more stably maintain contact between the contacts 18 and 58.

According to the sixth embodiment described above, the permanent magnets 800*g* are arranged at the positions that allow the entire movable contact member 50 to be placed between the permanent magnets 800*g* (FIG. 15). This is, however, not restrictive. The permanent magnets 800*g* may be arranged at any positions that generate the Lorentz force acting on the electric current flowing through the movable contact member 50 in the direction that moves the movable contact member 50 closer to the opposed fixed contacts 18. For example, the permanent magnets 800*g* may be arranged at the positions that allow at least either of the opposed sections 56 and the center section 52 to be placed between the permanent magnets 800*g*. This arrangement has the similar advantageous effects to those described above in the sixth embodiment.

H. Modifications

Among various components described in the above embodiments, the components other than those described in independent claims are additional and may be omitted according to the requirements. The invention is not limited to the above embodiments or examples, but a multiplicity of variations and modifications may be made to the embodiments without departing from the scope of the invention. Some examples of possible modifications are given below.

H-1. First Modification

The above embodiment adopts the mechanism of moving the movable iron core 72 by magnetic force as the driving structure 90. This is, however, not restrictive. Another mechanism may be adopted to move the movable contact member 50. For example, according to one adoptable mechanism, a lift assembly that is extendable by external operation may be placed in the center section 52 of the movable contact member 50 (FIG. 5) on the opposite side to the side of the fixed terminals 10 and may be extended or contracted to move the movable contact member 50. This modification has the similar advantageous effects to those described in the above embodiment. In the driving structure 90 of the above embodiment, the one end portion 60*b* of the rod 60 (FIG. 3) may be joined with the movable contact member 50. This modification enables the movable contact member 50 to move in conjunction with the movement of the movable iron core 72 without the first spring 62.

H-2. Second Modification

The plurality of first vessels 20 or 20*a* are all formed in cylindrical shape according to the above embodiments but may be formed in another shape. For example, at least one of the plurality of first vessels 20 or 20*a* may be formed in rectangular prism shape.

H-3. Third Modification

According to the second embodiment described above, the first vessel 20*a* has the step 27, and the joint area Q where the joint member 30 is joined with the first vessel 20*a* is formed on the step 27 that is part of the outer peripheral surface of the first vessel 20*a*. This is, however, not restrictive. The joint area Q may be formed at any position that is hidden (unviewable) from the fixed contact 18 and the movable contact 58 by the first vessel 20*a*. For example, the joint member 30 may be joined with the outer peripheral surface of the thick-wall section 25 of the first vessel 20*a*. In the application using the first vessels 20 of the first embodiment (FIG. 5), the joint member 30 may be joined with the outer surface (outer peripheral surface) of the side face member 22. Like the second and the third embodiments described above, such modifications also effectively reduce the possibility that an arc generated between the fixed contact 18 and the movable contact 58 comes into contact with the joint area Q where the joint member 30 is joined with the first vessel 20*a*.

H-4. Fourth Modification

According to the above embodiments, the movable contacts 58 or 58*a* are placed inside the first vessels 20 or 20*a* in the air-tight space 100, irrespective of the movement of the movable contact member 50 or 50*c*. This is, however, not restrictive. For example, in the state that the movable contacts 58 or 58*a* are furthest away from the fixed contacts 18 or 18*a*, the movable contacts 58 or 58*a* may be placed inside the second vessel 92 (FIG. 5) in the air-tight space 100. Like the first embodiment, even when electric arching causes and scatters the particulates of the component part of the fixed terminal 10, this modified structure enables the first vessels 20 or 20*a* to work as the barriers and thereby effectively reduces the possibility that the scattered particulates establish electrical continuity between the fixed terminals 10.

H-5. Fifth Modification

According to the above embodiments, the first vessel 20 or 20*a* has the bottom 24 (FIG. 3 or FIG. 7), and the fixed terminal 10 is joined with the outer surface 24*a* of the bottom 24. The joint position where the fixed terminal 10 is joined with the first vessel 20 or 20*a* is, however, not limited to this arrangement. For example, the fixed terminal 10 may be joined with the side face member 22. The first vessel 20 or 20*a* may be structured without the bottom 24. Like the above embodiments, even when electric arching causes and scatters the particulates of the component part of the fixed terminal 10, these modified structures enable the first vessels 20 or 20*a* to work as the barriers and thereby effectively reduce the possibility that the scattered particulates establish electrical continuity between the fixed terminals 10.

H-6. Sixth Modification

The positional relationship between the first vessel 20 or 20*a* and the fixed terminal 10 or 10*c* that is joined with the first vessel 20 or 20*a* is not specifically limited. It is, however, preferable that the fixed terminal 10 or 10*c* is joined with the first vessel 20 or 20*a*, such that the center line of the first vessel 20 or 20*a* is not aligned with the center line of the fixed terminal 10 or 10*c*. In other words, the first vessel 20 or 20*a* and the fixed terminal 10 or 10*c* are arranged, such that the center line of the fixed terminal 10 or 10*c* is offset (shifted) from the center line of the first vessel 20 or 20*a*. More specifically, the first vessel 20 or 20*a* and the fixed terminal 10 or 10*c* are arranged, such that the distance between the part of the fixed terminal 10 or 10*c* placed inside the first vessel 20 or 20*a* and the inner side face of the first vessel 20 or 20*a* is not fixed. Making the center line of the fixed terminal 10 or 10*c* offset from the center line of the first vessel 20 or 20*a* increases the distance of the arc extended by the Lorentz force and thereby accelerates arc extinction. The center line of the first vessel 20 or 20*a* or the center line of the fixed terminal 10 or 10*c* herein represents the line that passes through the center (center of gravity) between the upper end face and the lower end face of each member.

Especially it is preferable that the distance between the inner peripheral face (inner periphery) of the first vessel 20 and the fixed terminal 10 with respect to a first direction along which the arc is extended (for example, positive Y-axis direction for the fixed terminal 10 on the right side of FIG. 5, the direction of the Lorentz force) is longer than the distance between the inner peripheral face of the first vessel 20 and the fixed terminal 10 with respect to a second direction opposite to the first direction (negative Y-axis direction for the fixed terminal 10 on the right side of FIG. 5). According to the above embodiments, it is preferable that the center line of the fixed terminal 10 or 10*a* is offset inward from the center line of the first vessel 20 or 20*a* (to be closer to the first vessel 20 or 20*a*). This ensures the sufficient space where the arc is extended by the Lorentz force and enables further extension of the arc, thus more effectively accelerating arc extinction.

H-7. Seventh Modification

The first vessel 20 or 20*a* has the bottom 24 according to the above embodiments (for example, FIG. 3) but may be structured without the bottom. For example, the first vessel 20 or 20*a* may be structured to have only the side face member 22. Like the above embodiments, this modified structure enables the first vessel 20 or 20*a* to work as the barrier and thereby reduces the possibility that the scattered particulates establish electrical continuity between the fixed terminals 10.

H-8. Other Modifications

H-8-1. Modification of First Spring and Relevant Parts

According to the above embodiment, the first spring 62 has the other end fixed to the third vessel 34 and is not displaced with the movement of the rod 60 (FIG. 3). The first spring 62 is, however, not restricted to the structure of the above embodiment but may be structured to be displaced with the movement of the rod 60 or may have another modified structure. The following describes some specific examples.

Figure 16:
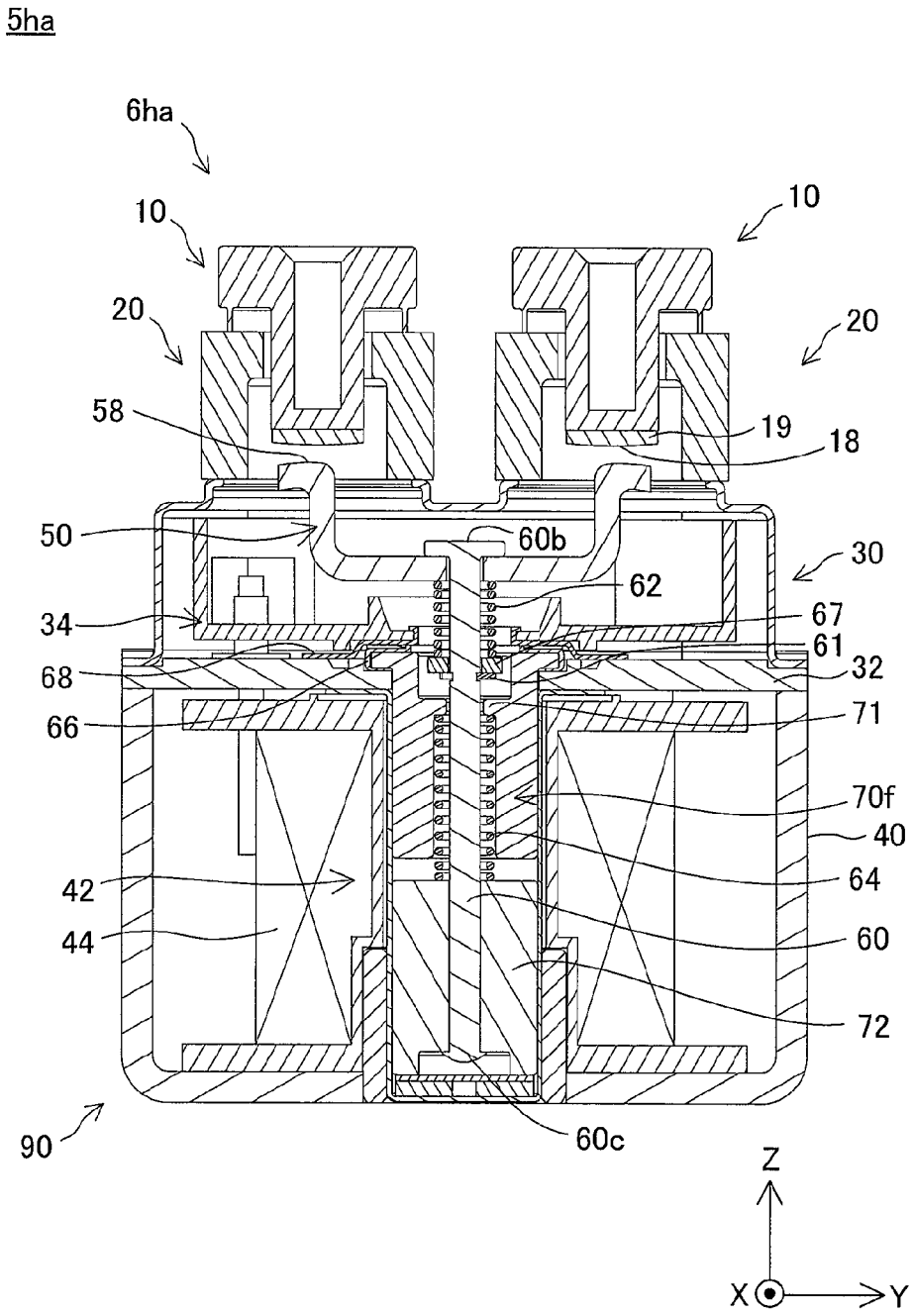
FIG. 16 is a diagram illustrating a relay 5*ha* according to Modification A.

FIG. 16 is a diagram illustrating a relay 5*ha* according to Modification A. FIG. 16 is a view equivalent to the 3-3 cross sectional view of FIG. 2B. The difference from the first embodiment is mainly the structure that is in contact with the other end of the first spring 62. The like parts to those of the relay 5 of the first embodiment are expressed by the like numerals or symbols and are not specifically described here.

As shown in FIG. 16, the first spring 62 has one end that is in contact with the movable contact member 50 and the other end that is in contact with a base seat 67. The base seat 67 is formed in circular shape. The base seat 67 is in contact with a C ring 61 fixed to the rod 60 and is thereby set at the fixed position relative to the rod 60. The base seat 67 is displaced with the movement of the rod 60. In other words, the first spring 62 is displaced with the movement of the rod 60. A cylindrical fixed iron core 70*f* has a projection 71 protruded inward. One end of the second spring 64 is in contact with the projection 71. Like the above embodiment, coil springs are used for the first spring 62 and the second spring 64. More specifically, helical compression springs are adopted like the above embodiment.

The relay 5*ha* of this structure operates in the following manner. As the coil 44 is energized, the movable iron core 72 moves closer to the fixed iron core 70*f* against the pressing force of the second spring 64 and comes into contact with the fixed iron core 70*f*. As the movable iron core 72 moves upward (direction closer to the fixed contacts 18), the rod 60 and the movable contact member 50 also move upward. This brings the movable contacts 58 into contact with the fixed contacts 18. In the state that the movable contacts 58 are in contact with the fixed contacts 18, the first spring 62 presses the movable contact member 50 toward the fixed contacts 18 to stably maintain contact between the fixed contacts 18 and the movable contacts 58.

Figure 17:
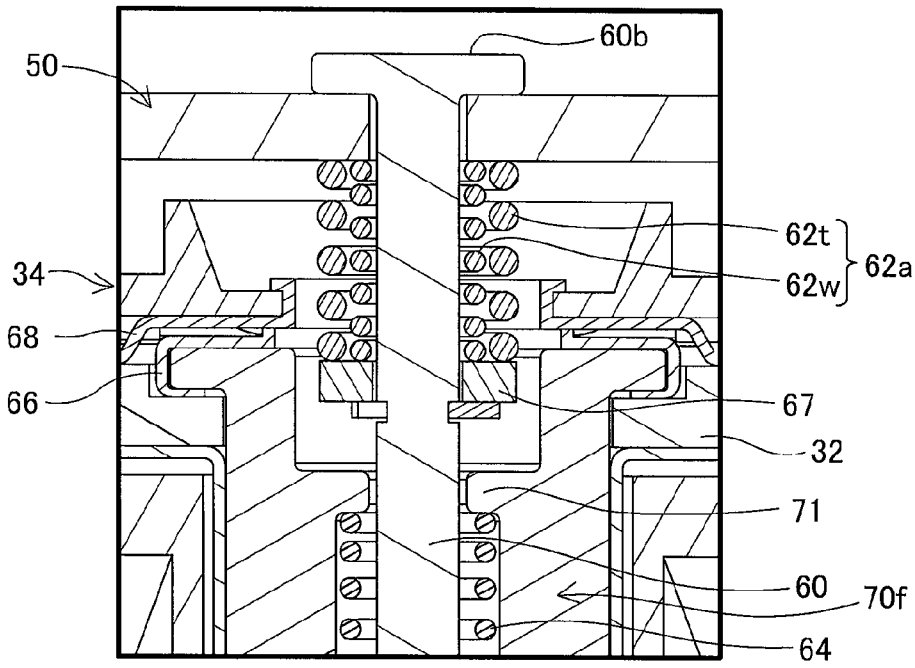
FIG. 17 is a diagram illustrating a first variation of Modification A.

FIG. 17 is a diagram illustrating a first variation of Modification A. FIG. 17 is a cross sectional view equivalent to the 3-3 cross sectional view of FIG. 2B and shows the periphery of a first spring member 62*a*. The difference between Modification A and the first variation shown in FIG. 17 is the structure of the first spring member 62*a* as the elastic member. The other structure is similar to that of Modification A. The like parts to those of the relay 5*ha* of Modification A are expressed by the like numerals or symbols and are not specifically described here. As shown in FIG. 17, the first spring member 62*a* includes an outer spring 62*t* and an inner spring 62*w*. Both the outer spring 62*t* and the inner spring 62*w* are coil springs. More specifically, both the outer spring 62*t* and the inner spring 62*w* are helical compression springs. The inner spring 62*w* is located inside the outer spring 62*t*. The inner spring 62*w* has a larger spring constant than the outer spring 62*t*. As described above, any of the relays 5 to 5*g* of the above embodiments may be structured to have a plurality of springs of different spring constants arranged in parallel as the elastic member that presses the movable contact member 50 or 50*c* against the fixed contacts 18 or 18*a*. In the structure that a plurality of coil springs are arranged in parallel in the radial direction of the springs, it is preferable that the winding directions of the adjacent springs are reverse to each other. This arrangement advantageously reduces the possibility that the adjacent springs are tangled with each other even after repeated extension and contraction of the springs. For example, in the variation of Modification A, the inner spring 62*w* may be right-handed, while the outer spring 62*t* may be left-handed. This arrangement reduces the possibility that the coil wind of the inner spring 62*w* intervenes between the coil winds of the outer spring 62*t*.

Figure 18:
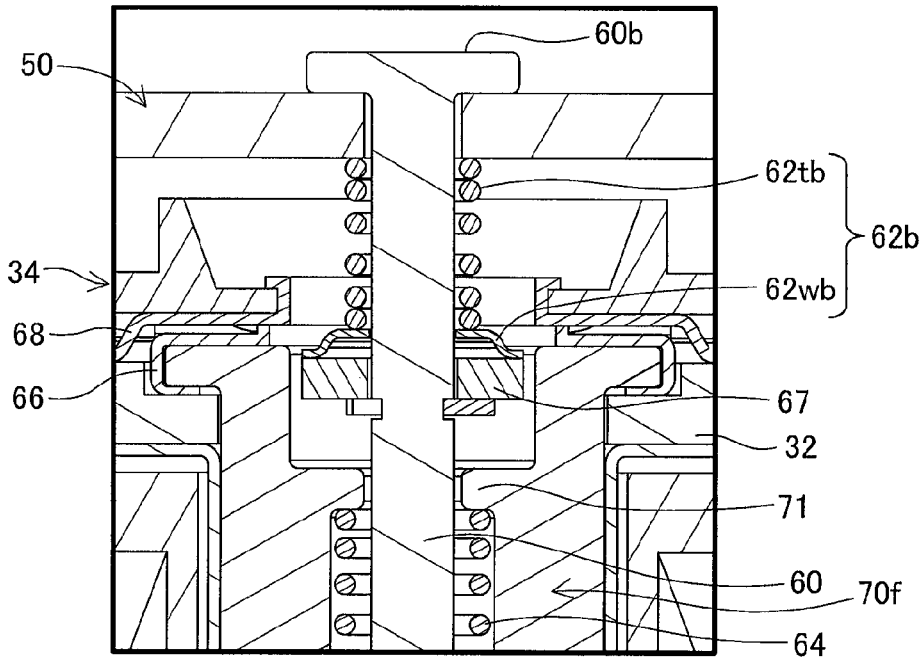
FIG. 18 is a diagram illustrating a second variation of Modification A.

FIG. 18 is a diagram illustrating a second variation of Modification A. FIG. 18 is a cross sectional view equivalent to the 3-3 cross sectional view of FIG. 2B and shows the periphery of a first spring member 62*b*. The difference between Modification A and the second variation shown in FIG. 18 is the structure of the first spring member 62*b* as the elastic member. The other structure is similar to that of Modification A. The like parts to those of the relay 5*ha* of Modification A are expressed by the like numerals or symbols and are not specifically described here. As shown in FIG. 18, the first spring member 62*b* includes a disc spring 62*wb* and a helical compression spring 62*tb*. More specifically, the disc spring 62*wb* and the helical compression spring 62*tb* are arranged in series. The disc spring 62*wb* and the helical compression spring 62*tb* have different spring constants. As described above, any of the relays 5 to 5*g* of the above embodiments may be structured to have a plurality of springs of different spring constants arranged in series as the elastic member that presses the movable contact member 50 or 50*c* against the fixed contacts 18 or 18*a*.

Figure 19:
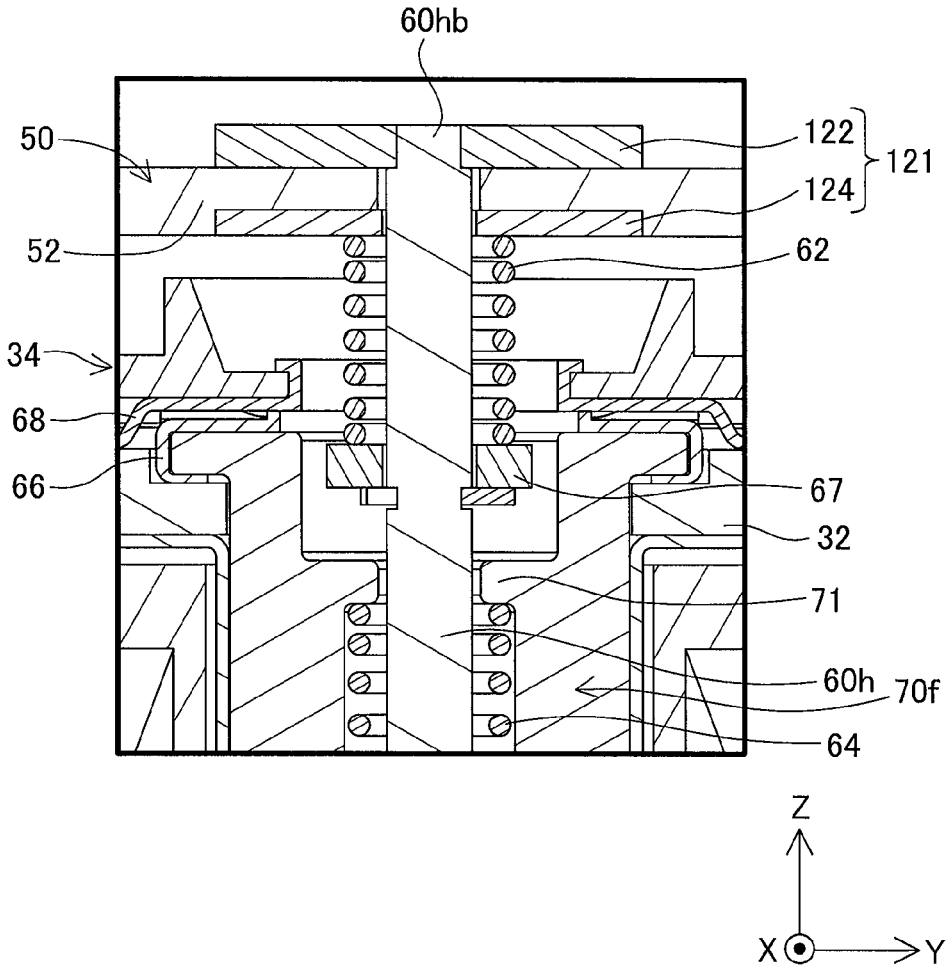
FIG. 19 is a diagram illustrating a third variation of Modification A.
Figure 20:
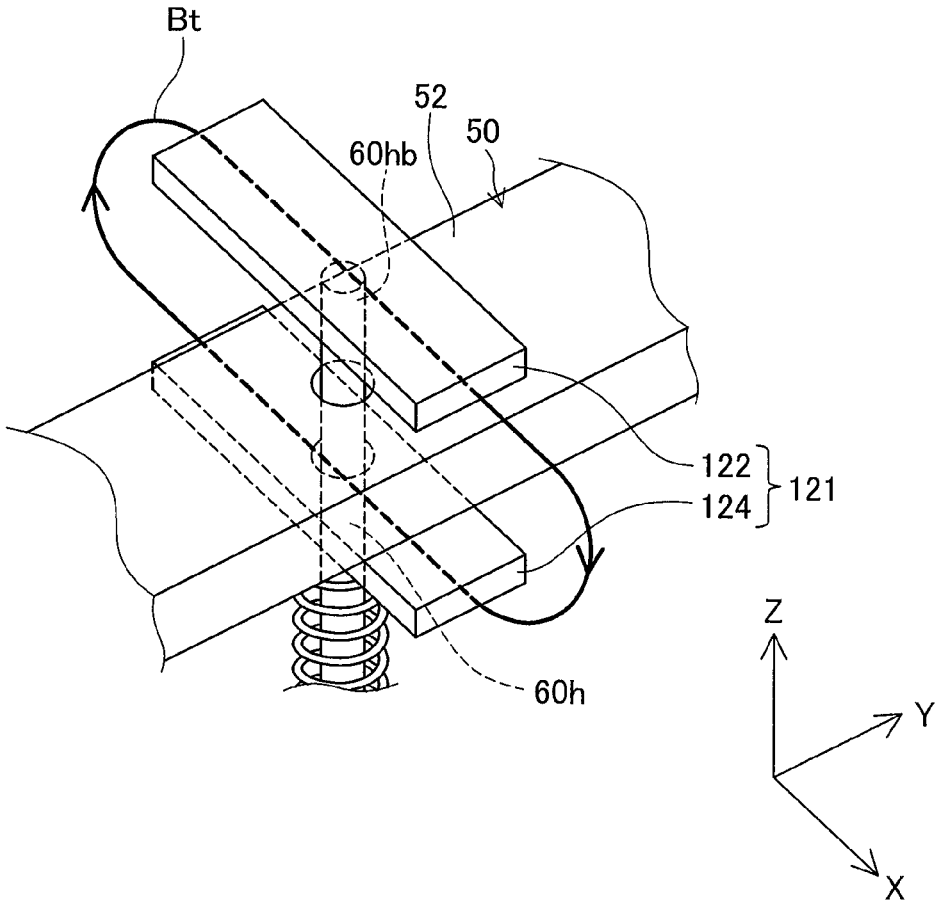
FIG. 20 is a diagram illustrating an auxiliary member 121.

FIG. 19 is a first diagram illustrating a third variation of Modification A. FIG. 20 is a second diagram illustrating the third variation. FIG. 19 is a cross sectional view equivalent to the 3-3 cross sectional view of FIG. 2B and shows the periphery of the first spring 62. FIG. 20 is a diagram illustrating an auxiliary member 121. The differences between Modification A and the third variation include the structure of a rod 60*h* and the addition of the auxiliary member 121. The other structure is similar to that of Modification A. The like parts to those of the relay 5*ha* of Modification A are expressed by the like numerals or symbols and are not specifically described here. The auxiliary member 121 generates a force in a direction that moves the movable contact member 50 closer to the fixed contacts 18 when the movable contacts 58 come into contact with the fixed contacts 18 and the electric current flows through the movable contact member 50. The following describes the third variation in more detail.

As shown in FIGS. 19 and 20, the auxiliary member 121 includes a first member 122 and a second member 124. The first member 122 and the second member 124 are both magnetic bodies. The first member 122 and the second member 124 are arranged across both sides of the movable contact member 50 (more specifically, its center section 52) in the moving direction of the movable contact member 50 (Z-axis direction). More specifically, the first member 122 is attached to one end portion 60*hb* of the rod 60*h* to be located on the side closer to the fixed contact 18 in the center section 52 of the movable contact member 50. The second member 124 is attached to the opposite side to the side of the first member 122 in the center section 52. As the electric current flows through the movable contact member 50, a magnetic field is generated in the periphery of the movable contact member 50. The generation of the magnetic field forms a magnetic flux Bt that passes through the first member 122 and the second member 124 (FIG. 20). The formation of the magnetic flux Bt produces attraction force (also called "magnetic attractive force") between the first member 122 and the second member 124. In other words, the attraction force of moving the second member 124 closer to the first member 122 acts on the second member 124. This attraction force causes the second member 124 to apply the force to the movable contact member 50 and press the movable contact member 50 against the fixed contacts 18. This stably maintains contact between the movable contacts 58 and the fixed contacts 18 opposed to each other. The structure of producing the magnetic adsorption is not restricted to the shape of the first member 122 and the second member 124 described above. For example, any of various structures described in JP 2011-23332A may be used for the structure of the first member 122 and the second member 124.

H-8-2. Modification of Joint Member and Relevant Parts

The joint member 30 is provided as a single member according to the above embodiment (for example, FIG. 5), but this is not restrictive. A plurality of members having different characteristics may be used in combination as the joint member. The following describes specific examples.

Figure 21:
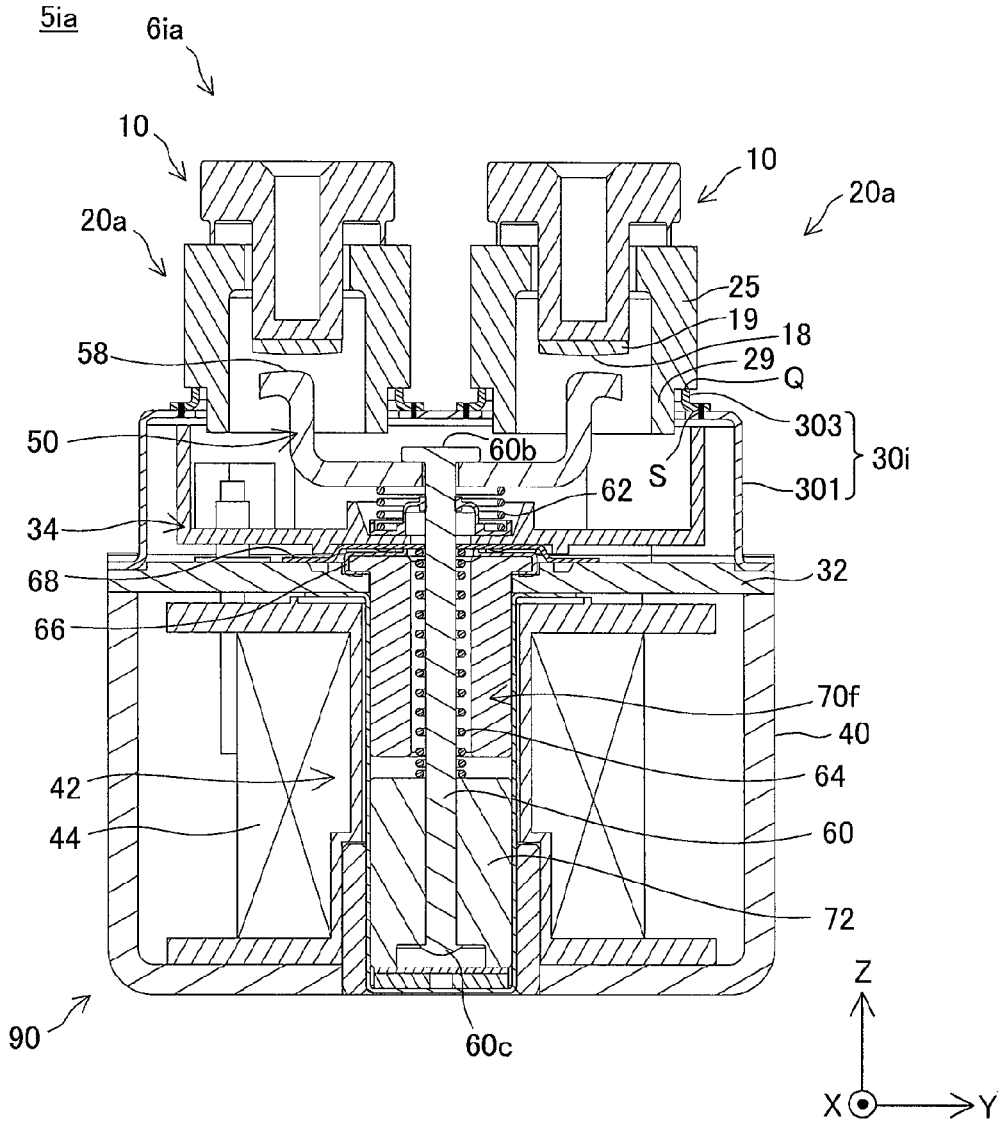
FIG. 21 is a diagram illustrating a relay 5*ia* according to Modification B.

FIG. 21 is a diagram illustrating a relay 5*ia* according to Modification B. FIG. 21 is a view equivalent to the 3-3 cross sectional view of FIG. 2B. The relay 5*ia* of Modification B has the similar structure to that of the relay 5*a* of the second embodiment. The difference between the relay 5*a* of the second embodiment and the relay 5*ia* of Modification B is the structure of a joint member 30*i*. The like parts to those of the relay 5*a* of the second embodiment are expressed by the like numerals or symbols and are not specifically described here.

As shown in FIG. 21, the joint member 30*i* includes a first joint member 301 and a second joint member 303. The first joint member 301 and the second joint member 303 are joined with each other by a welded part S formed by, for example, laser welding or resistance welding. The first joint member 301 and the second joint member 303 may be made of, for example, a metal material. The first joint member 301 and the second joint member 303 have different thermal expansion coefficients. More specifically, the second joint member 303 has a smaller thermal expansion coefficient than the first joint member 301. For example, the first joint member 301 may be made of stainless steel, and the second joint member 303 may be made of kovar or 42-alloy. Intervention of the second joint member 303 having the smaller thermal expansion coefficient between the stainless steel first joint member 301 and the ceramic first vessel 20*d* relieves the stress produced by the thermal expansion difference between the first vessel 20*a* and the first joint member 301. This reduces the possibility that the relay 5*ia* is damaged. The joint area Q formed by brazing and the welded part S formed by, for example, laser welding are at the positions hidden (unviewable) from the fixed contact 18 and the movable contact 58.

Figure 22:
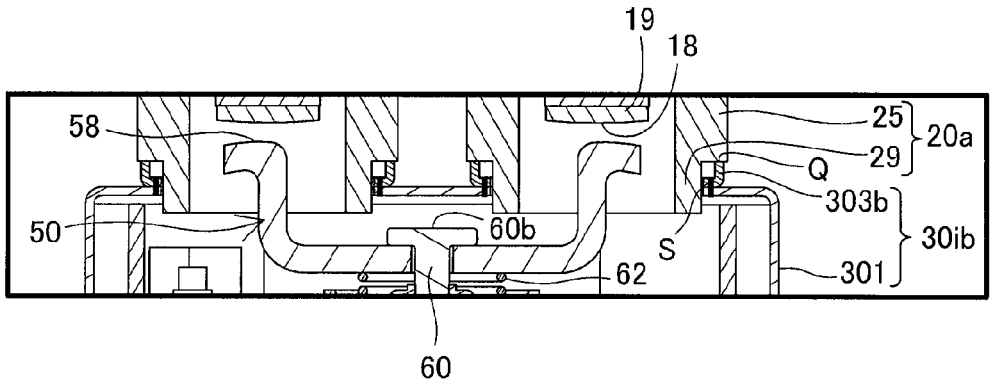
FIG. 22 is a diagram illustrating a first variation of Modification B.

FIG. 22 is a diagram illustrating a first variation of Modification B. The difference from Modification B is only the shape of a second joint member 303*b* of a joint member 30*ib*. In Modification B, the joint part of the second joint member 303 with the first joint member 301 is bent in the direction away from the first vessel 20 (FIG. 21). As shown in the first variation, however, the joint part of the second joint member 303*b* with the first joint member 301 may be bent in the direction closer to the first vessel 20.

Figure 23:
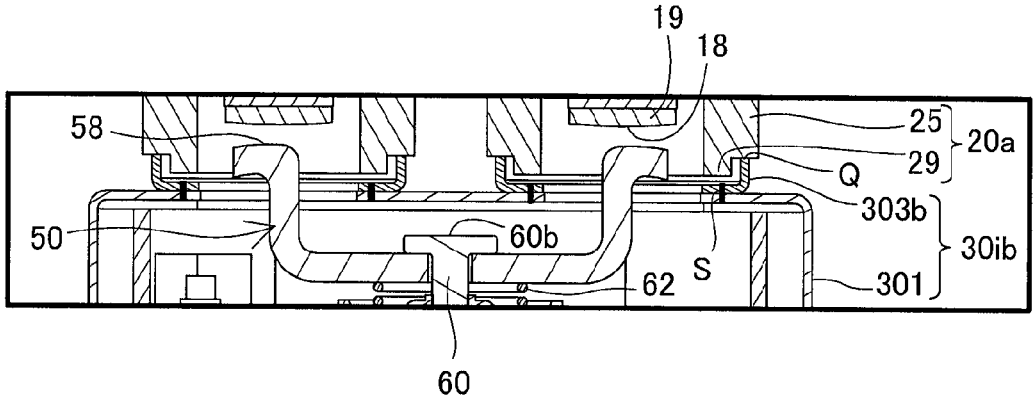
FIG. 23 is a diagram illustrating a second variation of Modification B.

FIG. 23 is a diagram illustrating a second variation of Modification B. The difference from the first variation is the positional relationship between the thin-wall section 29 and the welded part S. As shown in the second variation, the welded part S may be located at the position exposed on the fixed contact 18 and the movable contact 58 across the thin-wall section 29.

H-9. Ninth Modification

According to the fifth embodiment described above, the partition wall member 21 is extended from the bottom 24*f* to the position further away from the bottom 24*f* than the position where the pair of movable contacts 58 are located with respect to the moving direction of the movable contact member 50 (FIG. 12). This arrangement is, however, not restrictive. The partition wall member 21 may be extended from the bottom 24*f* to the position further away from the bottom 24*f* than at least the position where the pair of fixed contacts 18 are located. Even when electric arching causes and scatters the particulates of the component part of the fixed terminal 10, such modification enables the partition wall member 21 of the first vessel 20*f* to work as the barrier and thereby reduces the possibility that the particulates are accumulated to establish electrical continuity between the fixed terminals 10.

H-10. Tenth Modification

Figure 24:
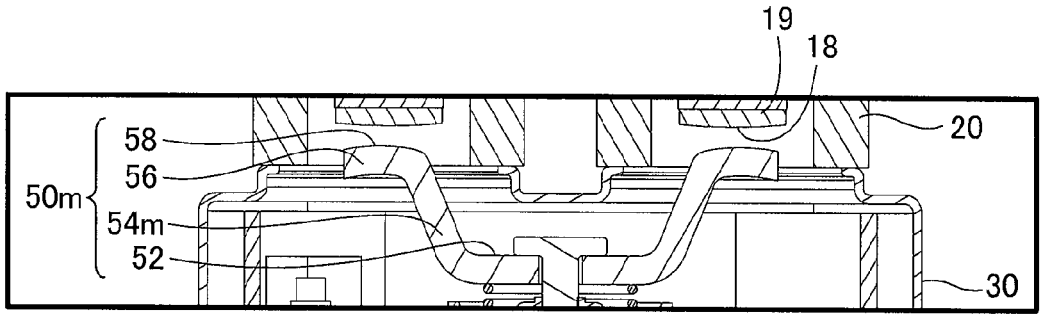
FIG. 24 is a diagram illustrating a movable contact member 50*m*.
Figure 25:
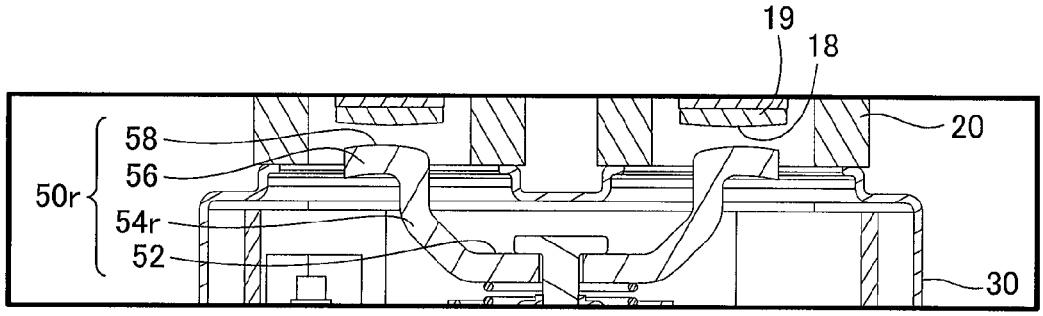
FIG. 25 is a diagram illustrating a movable contact member 50*r*.

The shape of the movable contact member 50 or 50*c* is not limited to the shapes described in the above embodiments. The shape of the movable contact member 50 or 50*c* is preferably a bent shape that prevents the movable contact member 50 or 50*c* from coming into contact with the first vessel 20, 20*a* or 20*f* during its movement. More specifically, it is preferable that the movable contact member 50 or 50*c* is formed in bent shape including the center section 52 and the movable contacts 58 located closer to the fixed contacts 18 or 18*a* than the center section 52 with respect to the moving direction. According to the above embodiment, the extended sections 54 are extended in the direction from the center section 52 arranged to allow insertion of the rod 60 toward the fixed contacts 18 or 18*a*, i.e., in the direction (positive Z-axis direction) parallel to the moving direction (Z-axis direction) (FIG. 3). This is, however, not restrictive. The extended sections 54 may be extended from the center section 52 in any direction including the positive Z-axis direction component. In other words, the extended sections 54 may be inclined to the moving direction, such as extended sections 54*m* of a movable contact member 50*m* shown in FIG. 24 or extended sections 54*r* of a movable contact member 50*r* shown in FIG. 25.

REFERENCE SIGNS LIST 5, 5*a*, 5*f*, 5*g*, 5*ha*, 5*ia*: Relay
6 to 6*g*: Relay main unit
10 (10P to 10S): Fixed terminal
10*c*: Fixed terminal
18: Fixed contact
18*a*: Fixed contact
20: First vessel
20*a*: First vessel
22: Side face member
22*a*: Side face member
24: Bottom

24*a*: Outer surface
26: Through hole
27: Step
28: Opening
30: Joint member
30*h*: Opening
31: Bottom face
50: Movable contact member
50*c*: Movable contact member
52: Center section
54: Extended section
54*a*: Cut plane
56: Opposed section
56*a*: Opposed section
58: Movable contact
58*a*: Movable contact
62: First spring
62*a*: First spring
90: Driving structure
92: Second vessel
100: Air-tight space
100*t*: Chamber
800, 800*g*: Permanent magnet
Q: Joint area

The invention claimed is:

1. A relay, comprising:

a plurality of fixed terminals arranged to have fixed contacts; and a movable contact member arranged to have a plurality of movable contacts that are correspondingly opposed to the respective fixed contacts, the relay further comprising:

a driving structure operated to move the movable contact member such that the respective movable contacts come into contact with the corresponding fixed contacts;

a plurality of first vessels provided corresponding to the respective fixed terminals, the plurality of first vessels having insulating property;

a second vessel joined with the plurality of first vessels; and an air-tight space formed by at least the plurality of fixed terminals, the plurality of first vessels and the second vessel and configured to allow the movable contact member and the respective fixed contacts to be placed therein.

2. The relay according to claim 1, wherein the respective fixed contacts are placed inside the corresponding first vessels in the air-tight space.

3. The relay according to claim 2, wherein the respective movable contacts are placed inside the corresponding first vessels in the air-tight space.

4. The relay according to claim 1, wherein each of the first vessels has an opening, and the second vessel is joined with at least one of the first vessels in at least either an end face of the opening or an outer peripheral surface of the first vessel.

5. The relay according to claim 1, wherein at least one of the first vessels has a through hole formed to allow one part of one of the fixed terminals to pass through, and another part of the fixed terminal is joined with an outer surface of the first vessel having the through hole.

6. The relay according to claim 1, wherein the movable contact member includes:

a center section that is extended in a direction perpendicular to a moving direction of the movable contact member, the center section being placed inside the second vessel in the air-tight space; and a plurality of extended sections that are extended from the center section toward the respective fixed terminals.

7. The relay according to claim 6, wherein the movable contact member further includes opposed sections that are extended from the extended portions in a direction perpendicular to the moving direction, wherein the opposed sections respectively have the movable contacts on respective faces opposed to the corresponding fixed contacts.

8. The relay according to claim 6, wherein the movable contact member further includes opposed sections that are extended from the extended portions in a direction that is perpendicular to the moving direction and is approximately parallel to a contact surface of each of the fixed contacts with the corresponding movable contact, wherein the opposed sections respectively have the movable contacts, and a contact area where the movable contact comes into contact with the corresponding fixed contact is greater than a cross sectional area of a cut plane of the extended section parallel to the contact surface.

9. The relay according to claim 1, wherein at least one of the plurality of first vessels is in cylindrical shape.

10. The relay according to claim 1, the relay being applied for a system including a power source and a load, the relay further comprising:

a magnet arranged to generate Lorentz force acting on electric current flowing through the movable contact member in a direction that moves the movable contact member closer to the opposed fixed contacts, when electric current flows through the relay during power supply from the power source to the load.

11. A relay, comprising:

a plurality of fixed terminals arranged to have fixed contacts; and a movable contact member arranged to have a plurality of movable contacts that are correspondingly opposed to the respective fixed contacts, the relay further comprising:

a driving structure operated to move the movable contact member such that the respective movable contacts come into contact with the corresponding fixed contacts;

a single first vessel configured to have a bottom and a plurality of chambers formed corresponding to the plurality of fixed terminals, and having insulating property, wherein the plurality of fixed terminals are inserted through and attached to the bottom, such that the plurality of fixed contacts are placed inside the first vessel and another part of the fixed terminals is placed outside the first vessel;

a second vessel joined with the first vessel; and an air-tight space configured to include the plurality of chambers and formed by at least the plurality of fixed terminals, the first vessel and the second vessel to allow the movable contact member and the respective fixed contacts to be placed therein, wherein the first vessel has a partition wall member extended from the bottom to a position further away from the bottom than at least a position where the plurality of fixed contacts are located, with respect to a moving direction of the movable contact member, and arranged to part the plurality of chambers from each other, wherein the respective fixed contacts are placed in the respective chambers in the air-tight space.

12. The relay according to claim 11, wherein the partition wall member is extended from the bottom to a position further away from the bottom than at least a position where the plurality of movable contacts are located, with respect to the moving direction of the movable contact member, wherein the respective movable contacts are placed in the respective chambers in the air-tight space.

* * * * *